US011767838B2

(12) United States Patent
Stover et al.

(10) Patent No.: US 11,767,838 B2
(45) Date of Patent: Sep. 26, 2023

(54) COMPRESSOR HAVING SUCTION FITTING

(71) Applicant: Emerson Climate Technologies, Inc., Sidney, OH (US)

(72) Inventors: Robert C. Stover, Versailles, OH (US); Keith M. Knippen, Tipp City, OH (US)

(73) Assignee: Copeland LP, Sidney, OH (US)

( * ) Notice: Subject to any disclaimer, the term of this patent is extended or adjusted under 35 U.S.C. 154(b) by 297 days.

(21) Appl. No.: 15/930,785

(22) Filed: May 13, 2020

(65) Prior Publication Data

US 2020/0392953 A1 Dec. 17, 2020

Related U.S. Application Data

(60) Provisional application No. 62/861,412, filed on Jun. 14, 2019.

(51) Int. Cl.

| | |
|---|---|
| ***F04B 39/12*** | (2006.01) |
| ***F04C 29/12*** | (2006.01) |
| ***F04C 23/00*** | (2006.01) |

(52) U.S. Cl.

CPC ..... *F04B 39/123* (2013.01); *F04C 29/12* (2013.01); *F04C 23/008* (2013.01)

(58) Field of Classification Search

CPC ..... F04B 39/123; F04B 39/066; F04B 39/12; F04C 29/12; F04C 23/008; F04C 18/0215; F04C 2240/30; F04C 2240/806

See application file for complete search history.

(56) References Cited

U.S. PATENT DOCUMENTS

| | | | | |
|---|---|---|---|---|
| 1,365,530 A | | 1/1921 | Moore | |
| 2,142,452 A | | 1/1939 | Merrill | |
| 2,157,918 A | | 5/1939 | Rankin | |
| 2,855,139 A | * | 10/1958 | Weibel, Jr. | F25B 31/02 417/372 |
| 3,075,686 A | | 1/1963 | Steinhagen | |

(Continued)

FOREIGN PATENT DOCUMENTS

| | | |
|---|---|---|
| CN | 1208821 A | 2/1999 |
| CN | 1278892 A | 1/2001 |

(Continued)

OTHER PUBLICATIONS

Non-Final Office Action regarding U.S. Appl. No. 16/803,576 dated Jun. 1, 2021.

(Continued)

*Primary Examiner* — Nathan C Zollinger

(74) *Attorney, Agent, or Firm* — Harness, Dickey & Pierce, P.L.C.

(57) ABSTRACT

A compressor includes a shell assembly, a compression mechanism and a suction fitting. The shell assembly defines a chamber. The compression mechanism is disposed within the chamber of the shell assembly and includes a suction inlet. The suction fitting is attached to the shell assembly and extends at least partially into the chamber of the shell assembly. The suction fitting defines first and second openings. The suction fitting directs working fluid through the first opening towards the compression mechanism and the suction fitting directs working fluid through the second opening away from the compression mechanism.

19 Claims, 14 Drawing Sheets

(56) References Cited

U.S. PATENT DOCUMENTS 3,270,952 A * 9/1966 Bellmer ..... F25B 31/02 137/467.5
3,817,661 A 6/1974 Ingalls et al.
3,870,440 A 3/1975 Zuercher, Jr.
4,313,715 A 2/1982 Richardson, Jr.
4,343,599 A 8/1982 Kousokabe
4,365,941 A 12/1982 Tojo et al.
4,401,418 A 8/1983 Fritchman
4,412,791 A 11/1983 Lal
4,477,229 A 10/1984 Kropiwnicki et al.
4,496,293 A 1/1985 Nakamura et al.
4,564,339 A 1/1986 Nakamura et al.
4,592,703 A 6/1986 Inaba et al.
4,609,334 A 9/1986 Muir et al.
4,648,811 A 3/1987 Tahata et al.
4,696,629 A 9/1987 Shiibayashi et al.
4,759,696 A 7/1988 Ishiai
4,767,293 A 8/1988 Caillat et al.
4,793,775 A 12/1988 Peruzzi
4,838,769 A 6/1989 Gannaway
4,877,382 A 10/1989 Caillat et al.
4,915,554 A 4/1990 Serizawa et al.
4,969,804 A * 11/1990 Gannaway ..... F04B 39/123 417/902
5,007,809 A 4/1991 Kimura et al.
5,030,073 A 7/1991 Serizawa et al.
5,055,010 A 10/1991 Logan
5,064,356 A 11/1991 Horn
5,108,274 A 4/1992 Kakuda et al.
5,114,322 A 5/1992 Caillat et al.
5,197,868 A 3/1993 Caillat et al.
5,219,281 A 6/1993 Caillat et al.
5,240,391 A * 8/1993 Ramshankar ..... F04C 29/045 417/372
5,288,211 A 2/1994 Fry
5,295,813 A 3/1994 Caillat et al.
5,306,126 A 4/1994 Richardson, Jr.
5,344,289 A 9/1994 Fasce
5,366,352 A 11/1994 Deblois et al.
5,427,511 A 6/1995 Caillat et al.
5,435,700 A 7/1995 Park
5,439,361 A 8/1995 Reynolds et al.
5,476,369 A 12/1995 Fowlkes et al.
5,531,078 A 7/1996 Day et al.
5,533,875 A 7/1996 Crum et al.
5,593,294 A 1/1997 Houghtby et al.
5,597,293 A 1/1997 Bushnell et al.
5,645,408 A 7/1997 Fujio et al.
5,707,210 A * 1/1998 Ramsey ..... F04C 28/28 417/310
5,745,992 A 5/1998 Caillat et al.
5,772,411 A 6/1998 Crum et al.
5,772,416 A 6/1998 Caillat et al.
5,931,649 A 8/1999 Caillat et al.
5,992,033 A 11/1999 Scarborough
6,000,917 A * 12/1999 Smerud ..... F04C 29/023 417/366
6,017,205 A 1/2000 Weatherston et al.
6,131,406 A 10/2000 Barowsky et al.
6,139,295 A 10/2000 Utter et al.
6,158,995 A 12/2000 Muramatsu et al.
6,164,934 A 12/2000 Niihara et al.
6,168,404 B1 1/2001 Gatecliff
6,174,150 B1 1/2001 Tsubono et al.
6,186,753 B1 * 2/2001 Hugenroth ..... F04C 18/0215 418/55.6
6,244,834 B1 6/2001 Matsuda et al.
6,261,071 B1 7/2001 Williams et al.
6,293,776 B1 9/2001 Hahn et al.
6,352,418 B1 3/2002 Kohsokabe et al.
6,364,643 B1 4/2002 Milliff
6,402,485 B2 6/2002 Hong et al.
6,454,538 B1 9/2002 Witham et al.
6,474,964 B2 * 11/2002 De Bernardi ..... F04C 23/008 418/55.6
6,537,019 B1 3/2003 Dent
6,685,441 B2 2/2004 Nam
6,709,244 B2 3/2004 Pham
6,736,607 B2 5/2004 Ginies et al.
6,814,546 B2 11/2004 Sekiguchi
6,857,808 B1 2/2005 Sugimoto et al.
6,887,050 B2 5/2005 Haller
6,896,496 B2 5/2005 Haller et al.
7,018,183 B2 3/2006 Haller et al.
7,018,184 B2 3/2006 Skinner et al.
7,063,523 B2 6/2006 Skinner
7,094,043 B2 8/2006 Skinner
7,108,494 B2 9/2006 Nam
7,137,775 B2 11/2006 Hopkins
7,147,443 B2 12/2006 Ogawa et al.
7,207,787 B2 4/2007 Liang et al.
7,311,501 B2 * 12/2007 Wehrenberg ..... F04C 29/026 418/55.6
7,318,710 B2 1/2008 Lee et al.
7,416,395 B2 8/2008 Sato
7,503,755 B2 3/2009 Lai et al.
RE40,830 E 7/2009 Caillat
7,686,592 B2 3/2010 Inoue et al.
7,699,589 B2 4/2010 Terauchi et al.
7,708,536 B2 * 5/2010 Ginies ..... F04C 23/008 418/94
7,771,180 B2 8/2010 Cho et al.
7,862,312 B2 1/2011 Gopinathan
7,905,715 B2 3/2011 Hiwata et al.
8,133,043 B2 3/2012 Duppert
8,152,503 B2 4/2012 Haller
8,348,647 B2 1/2013 Kiyokawa et al.
8,814,537 B2 8/2014 Ignatiev et al.
8,974,198 B2 3/2015 Schaefer et al.
8,992,186 B2 3/2015 Silveira et al.
9,051,934 B2 6/2015 Fraser
9,057,270 B2 6/2015 Strawn et al.
9,366,462 B2 6/2016 Perevozchikov et al.
10,094,600 B2 10/2018 Doepker et al.
2001/0006603 A1 7/2001 Hong et al.
2001/0055536 A1 12/2001 Bernardi et al.
2002/0090305 A1 7/2002 Myung et al.
2003/0072662 A1 4/2003 Reinhart
2004/0057843 A1 3/2004 Haller et al.
2004/0057849 A1 3/2004 Skinner et al.
2004/0057857 A1 3/2004 Skinner
2004/0126258 A1 * 7/2004 Lai ..... F04C 29/045 418/55.1
2004/0166008 A1 8/2004 Lai et al.
2004/0170509 A1 * 9/2004 Wehrenberg ..... F04C 29/026 417/410.5
2004/0228751 A1 11/2004 Shin
2005/0129534 A1 6/2005 Lee
2006/0073061 A1 4/2006 Sato
2006/0078452 A1 4/2006 Park et al.
2006/0127262 A1 6/2006 Shin et al.
2006/0177335 A1 8/2006 Hwang et al.
2006/0222545 A1 10/2006 Nam et al.
2006/0222546 A1 10/2006 Lee et al.
2006/0245967 A1 11/2006 Gopinathan
2006/0275150 A1 12/2006 Barth
2007/0178002 A1 8/2007 Hiwata et al.
2007/0183914 A1 8/2007 Gopinathan
2007/0237664 A1 10/2007 Joo et al.
2009/0110586 A1 4/2009 Brabek et al.
2009/0136344 A1 5/2009 Chen et al.
2009/0229303 A1 9/2009 Iversen et al.
2010/0021330 A1 1/2010 Haller
2010/0092320 A1 * 4/2010 Duppert ..... F04B 39/16 418/55.6
2012/0134859 A1 5/2012 Duppert
2012/0148433 A1 6/2012 Liang et al.
2012/0328424 A1 * 12/2012 Berger ..... F02M 25/06 415/182.1
2013/0026749 A1 1/2013 O'Brien et al.
2013/0039792 A1 2/2013 Hiratsuka et al.

(56) References Cited

U.S. PATENT DOCUMENTS

| | | | | |
|---|---|---|---|---|
| 2013/0081710 | A1* | 4/2013 | Ignatiev | F04C 29/045 137/565.01 |
| 2013/0089451 | A1 | 4/2013 | Ahn et al. | |
| 2013/0108496 | A1 | 5/2013 | Nakai et al. | |
| 2013/0129549 | A1 | 5/2013 | Sakuda et al. | |
| 2014/0017106 | A1* | 1/2014 | Strawn | F04C 29/12 55/447 |
| 2014/0069139 | A1 | 3/2014 | Perevozchikov et al. | |
| 2016/0348675 | A1 | 12/2016 | Shii et al. | |
| 2017/0002812 | A1 | 1/2017 | Duppert | |
| 2018/0320689 | A1 | 11/2018 | Kono et al. | |
| 2019/0041106 | A1 | 2/2019 | Piscopo | |
| 2019/0041107 | A1 | 2/2019 | Piscopo et al. | |
| 2020/0309124 | A1 | 10/2020 | King | |

FOREIGN PATENT DOCUMENTS

| | | | |
|---|---|---|---|
| CN | 1321836 | A | 11/2001 |
| CN | 1354326 | A | 6/2002 |
| CN | 1371444 | A | 9/2002 |
| CN | 1482365 | A | 3/2004 |
| CN | 1629476 | A | 6/2005 |
| CN | 1779244 | A | 5/2006 |
| CN | 1869443 | A | 11/2006 |
| CN | 101235932 | A | 8/2008 |
| CN | 101415947 | A | 4/2009 |
| CN | 102216617 | A | 10/2011 |
| CN | 202926625 | U | 5/2013 |
| CN | 103201516 | A | 7/2013 |
| CN | 203453064 | U | 2/2014 |
| CN | 104350279 | A | 2/2015 |
| CN | 104976448 | A | 10/2015 |
| CN | 104999172 | A | 10/2015 |
| CN | 204934897 | U | 1/2016 |
| CN | 205064214 | U | 3/2016 |
| CN | 107246393 | A | 10/2017 |
| CN | 111065823 | A | 4/2020 |
| EP | 0438243 | A1 | 7/1991 |
| EP | 475545 | A1 | 3/1992 |
| EP | 0529660 | A1 | 3/1993 |
| EP | 1338795 | A1 | 8/2003 |
| EP | 1541868 | A1 | 6/2005 |
| JP | S62182486 | A | 8/1987 |
| JP | S63183773 | A | 7/1988 |
| JP | H04347387 | A | 12/1992 |
| JP | H05157064 | A | 6/1993 |
| JP | H05302581 | A | 11/1993 |
| JP | H07197893 | A | 8/1995 |
| JP | H08319965 | A | 12/1996 |
| JP | H11141470 | A | 5/1999 |
| JP | 2001165065 | A | 6/2001 |
| JP | 2002155875 | A | 5/2002 |
| JP | 2002155877 | A | 5/2002 |
| JP | 2002235524 | A | 8/2002 |
| JP | 2003120539 | A | 4/2003 |
| JP | 2004150370 | A | 5/2004 |
| JP | 2005188353 | A | 7/2005 |
| JP | 2006144729 | A | 6/2006 |
| JP | 2008223605 | A | 9/2008 |
| JP | 2009019570 | A | 1/2009 |
| JP | 2010043627 | A | 2/2010 |
| JP | 2011236861 | A | 11/2011 |
| KR | 20010064538 | A | 7/2001 |
| KR | 20010068323 | A | 7/2001 |
| KR | 20020024708 | A | 4/2002 |
| KR | 20080019509 | A | 3/2008 |
| KR | 20090045352 | A | 5/2009 |
| KR | 20140034345 | A | 3/2014 |
| KR | 20180107482 | A | 10/2018 |
| KR | 20190025250 | A | 3/2019 |
| WO | WO-2006109475 | A1 | 10/2006 |
| WO | WO-2007025883 | A1 | 3/2007 |
| WO | WO-2007114582 | A1 | 10/2007 |
| WO | WO-2008102940 | A1 | 8/2008 |
| WO | WO-2009090856 | A2 | 7/2009 |
| WO | WO-2011147005 | A1 | 12/2011 |
| WO | WO-2014043444 | A1 | 3/2014 |

OTHER PUBLICATIONS

Non-Final Office Action regarding U.S. Appl. No. 16/941,060 dated Aug. 2, 2021.

International Search Report regarding International Application No. PCT/US2020/037004, dated Sep. 21, 2020.

Written Opinion of the International Searching Authority regarding International Application No. PCT/US2020/037004, dated Sep. 21, 2020.

Notice of Allowance regarding U.S. Appl. No. 16/154,097, dated Oct. 27, 2020.

Notice of Allowance regarding U.S. Appl. No. 16/154,364, dated Jan. 6, 2021.

U.S. Appl. No. 16/803,576, filed Feb. 27, 2020, Joshua S. King.

U.S. Appl. No. 16/941,060, filed Jul. 28, 2020, Keith J. Reinhart et al.

International Search Report regarding International Application No. PCT/BR2010/000179, dated Sep. 1, 2010.

Written Opinion of the International Searching Authority regarding International Application No. PCT/BR2010/000179, dated Sep. 1, 2010.

International Search Report regarding International Application No. PCT/US2012/056067, dated Feb. 19, 2013.

Written Opinion of the International Searching Authority regarding International Application No. PCT/US2012/056067, dated Feb. 19, 2013.

Restriction Requirement regarding U.S. Appl. No. 13/610,274, dated Aug. 16, 2013.

Search Report regarding European Patent Application No. 10851912.5, dated Nov. 15, 2013.

Office Action regarding Japanese Patent Application No. 2013-511484, dated Nov. 19, 2013.

Office Action regarding U.S. Appl. No. 13/610,274, dated Nov. 27, 2013.

International Search Report regarding International Application No. PCT/US2013/059612, dated Dec. 9, 2013.

Written Opinion of the International Searching Authority regarding International Application No. PCT/US2013/059612, dated Dec. 9, 2013.

Office Action regarding U.S. Appl. No. 13/699,207, dated Dec. 18, 2013.

Notice of Allowance regarding U.S. Appl. No. 13/610,274, dated Mar. 24, 2014.

Notice of Allowance regarding U.S. Appl. No. 13/610,274, dated Jul. 18, 2014.

Office Action regarding European Patent Application No. 10851912.5, dated Jul. 18, 2014.

Office Action regarding U.S. Appl. No. 13/699,207, dated Jul. 24, 2014.

Office Action regarding Chinese Patent Application No. 201080066999.X, dated Sep. 17, 2014.

Notice of Allowance regarding U.S. Appl. No. 13/699,207, dated Nov. 24, 2014.

Office Action regarding Chinese Patent Application No. 201210376153.7, dated Dec. 3, 2014. Translation provided by Unitalen Attorneys At Law.

Restriction Requirement regarding U.S. Appl. No. 14/025,887, dated Jan. 5, 2015.

Restriction Requirement regarding U.S. Appl. No. 13/930,834, dated Jan. 29, 2015.

Office Action regarding U.S. Appl. No. 14/025,887, dated Mar. 26, 2015.

Notice of Allowance regarding U.S. Appl. No. 13/930,834, dated Apr. 24, 2015.

Office Action regarding Chinese Patent Application No. 201210376153.7, dated Jul. 3, 2015. Translation provided by Unitalen Attorneys at Law.

(56) References Cited

OTHER PUBLICATIONS

Office Action regarding U.S. Appl. No. 14/025,887, dated Jul. 23, 2015.
Office Action regarding Chinese Patent Application No. 201310286638.1, dated Jul. 27, 2015. Translation provided by Unitalen Attorneys at Law.
Office Action regarding U.S. Appl. No. 14/025,887, dated Dec. 3, 2015.
Office Action regarding Chinese Patent Application No. 201210376153.7, dated Dec. 28, 2015. Translation provided by Unitalen Attorneys at Law.
Office Action regarding Chinese Patent Application No. 201310286638.1, dated Jan. 21, 2016. Translation provided by Unitalen Attorneys at Law.
Office Action regarding Chinese Patent Application No. 201380047907.7, dated Mar. 8, 2016. Translation provided by Unitalen Attorneys at Law.
Notice of Allowance regarding U.S. Appl. No. 14/025,887, dated Apr. 12, 2016.
Search Report regarding European Patent Application No. 13836817.0, dated Jun. 1, 2016.
Office Action regarding Korean Patent Application No. 10-2012-7033723, dated Aug. 22, 2016.
Office Action regarding Chinese Patent Application No. 201380047907.7, dated Nov. 8, 2016. Translation provided by Unitalen Attorneys at Law.
Office Action regarding Chinese Patent Application No. 201380047907.7, dated Apr. 12, 2017. Translation provided by Unitalen Attorneys at Law.
Office Action regarding U.S. Appl. No. 15/180,570, dated Oct. 5, 2017.
Office Action regarding U.S. Appl. No. 15/180,570, dated Mar. 22, 2018.
Notice of Allowance regarding U.S. Appl. No. 15/180,570, dated May 31, 2018.
Notice of Allowance regarding U.S. Appl. No. 15/180,570, dated Jul. 19, 2018.
Office Action regarding Indian Patent Application No. 476/MUMNP/2015, dated Sep. 7, 2018.
Office Action regarding Indian Patent Application No. 10655/DELNP/2012, dated Sep. 28, 2018.
Office Action regarding European Patent Application No. 13836817.0, dated Sep. 10, 2019.
Office Action regarding U.S. Appl. No. 16/154,097, dated Jun. 23, 2020.
International Search Report regarding International Application No. PCT/US2020/025564, dated Jul. 8, 2020.
Written Opinion of the International Searching Authority regarding International Application No. PCT/US2020/025564, dated Jul. 8, 2020.
Office Action regarding U.S. Appl. No. 16/154,364, dated Aug. 17, 2020.
Notice of Allowance regarding U.S. Appl. No. 16/941,060 dated Oct. 6, 2021.
Notice of Allowance regarding U.S. Appl. No. 16/803,576 dated Sep. 16, 2021.
Restriction Requirement regarding U.S. Appl. No. 17/159,692 dated Apr. 11, 2022.
International Search Report regarding Application No. PCT/US2022/014027 dated May 4, 2022.
Written Opinion of ISA regarding Application No. PCT/US2022/014027 dated May 4, 2022.
Non-Final Office Action regarding U.S. Appl. No. 17/159,692 dated Jul. 21, 2022.
Notice of Allowance regarding U.S. Appl. No. 17/159,692 dated Dec. 2, 2022.
Office Action regarding Chinese Patent Application No. 2020800436550, dated Jan. 20, 2023.

* cited by examiner

COMPRESSOR HAVING SUCTION FITTING

CROSS-REFERENCE TO RELATED APPLICATIONS

This application claims the benefit of U.S. Provisional Application No. 62/861,412, filed on Jun. 14, 2019. The entire disclosure of the above application is incorporated herein by reference.

FIELD

The present disclosure relates to a compressor having a suction fitting.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that includes a shell assembly, a compression mechanism and a suction fitting. The shell assembly defines a chamber. The compression mechanism is disposed within the chamber of the shell assembly and includes a suction inlet. The suction fitting is attached to the shell assembly and extends at least partially into the chamber of the shell assembly. The suction fitting defines first and second openings. The suction fitting directs working fluid through the first opening towards the compression mechanism and the suction fitting directs working fluid through the second opening away from the compression mechanism.

In some configurations of the compressor of the above paragraph, the suction fitting has an axial end wall that defines the first opening at an axial end of the suction fitting.

In some configurations of the compressor of any one or more of the above paragraphs, a motor is disposed within the chamber and drives the compression mechanism. The suction fitting directs working fluid through the second opening towards the motor.

In some configurations of the compressor of any one or more of the above paragraphs, the suction fitting includes an axial end wall. The axial end wall deflects working fluid flowing through the suction fitting towards the first and second openings.

In some configurations of the compressor of any one or more of the above paragraphs, the first and second openings are formed between axial ends of the suction fitting.

In some configurations of the compressor of any one or more of the above paragraphs, the first and second openings extend radially through inner and outer diametrical surfaces of the suction fitting.

In some configurations of the compressor of any one or more of the above paragraphs, the first opening has a larger area than the second opening such that a greater volume of working fluid flowing through the suction fitting flows out of the first opening than the second opening.

In some configurations of the compressor of any one or more of the above paragraphs, the first and second openings are circular-shaped.

In some configurations of the compressor of any one or more of the above paragraphs, the suction fitting is axially misaligned with the suction inlet.

In some configurations of the compressor of any one or more of the above paragraphs, the first opening is a first elongated slot and the second opening is a second elongated slot.

In some configurations of the compressor of any one or more of the above paragraphs, the first and second elongated slots extend radially through inner and outer diametrical surfaces of the suction fitting.

In some configurations of the compressor of any one or more of the above paragraphs, the second elongated slot has a larger area than the first elongated slot.

In some configurations of the compressor of any one or more of the above paragraphs, the first and second elongated slots are arcuate.

In some configurations of the compressor of any one or more of the above paragraphs, a base plate is attached to an axial end of the suction fitting and cooperates with the suction fitting to define the first and second elongated slots.

In some configurations of the compressor of any one or more of the above paragraphs, the base plate deflects working fluid flowing through the suction fitting towards the first and second elongated slots.

In another form, the present disclosures provides a compressor that includes a shell assembly, a compression mechanism, a motor and a suction fitting assembly. The shell assembly defines a chamber. The compression mechanism is disposed within the chamber of the shell assembly and includes a suction inlet. The motor is disposed within the chamber and drives the compression mechanism. The suction fitting assembly includes a suction fitting and a deflector. The suction fitting is attached to the shell assembly and extends at least partially into the chamber. The deflector is attached to the suction fitting. A first portion of working fluid exiting the suction fitting flows to the suction inlet of the compression mechanism and a second portion of working fluid exiting the suction fitting is directed toward the motor via the deflector.

In some configurations of the compressor of the above paragraph, the suction fitting includes an outlet opening. The deflector includes a first body portion that divides the outlet opening into a first outlet opening section and a second outlet opening section.

In some configurations of the compressor of any one or more of the above paragraphs, the first portion of working fluid exits the suction fitting through the first outlet opening section and the second portion of working fluid exits the suction fitting through the second outlet opening section.

In some configurations of the compressor of any one or more of the above paragraphs, a partition extends from an end of the first body portion toward the suction fitting. The partition prevents the second portion of working fluid flowing through the second outlet opening section from flowing toward the compression mechanism.

In some configurations of the compressor of any one or more of the above paragraphs, the deflector includes a first body portion and a second body portion extending from the first body portion. The first body portion defines a channel that directs the second portion of working fluid flowing therethrough toward the motor.

In some configurations of the compressor of any one or more of the above paragraphs, the deflector includes a plurality of resiliently flexible members extending from the second body portion. The plurality of resiliently flexible members snap into engagement with the suction fitting.

In some configurations of the compressor of any one or more of the above paragraphs, the deflector includes tabs that extends outwardly from ends of the first body portion. The tabs contact the shell assembly to bias the deflector against the suction fitting.

In some configurations of the compressor of any one or more of the above paragraphs, the deflector snaps into engagement with the suction fitting.

In yet another form, the present disclosures provides a compressor that includes a shell assembly, a compression mechanism and a suction fitting. The shell assembly defines a chamber. The compression mechanism is disposed within the chamber of the shell assembly. The suction fitting is attached to the shell assembly and extends at least partially into the chamber. The suction fitting defines an opening and includes an axial end wall. The suction fitting directs working fluid through the opening towards the compression mechanism.

In some configurations of the compressor of the above paragraph, the opening is formed at an axial end of the suction fitting.

In some configurations of the compressor of any one or more of the above paragraphs, the axial end wall deflects working fluid flowing through the suction fitting towards the opening.

In some configurations of the compressor of any one or more of the above paragraphs, the axial end wall is a semi-circular shape.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
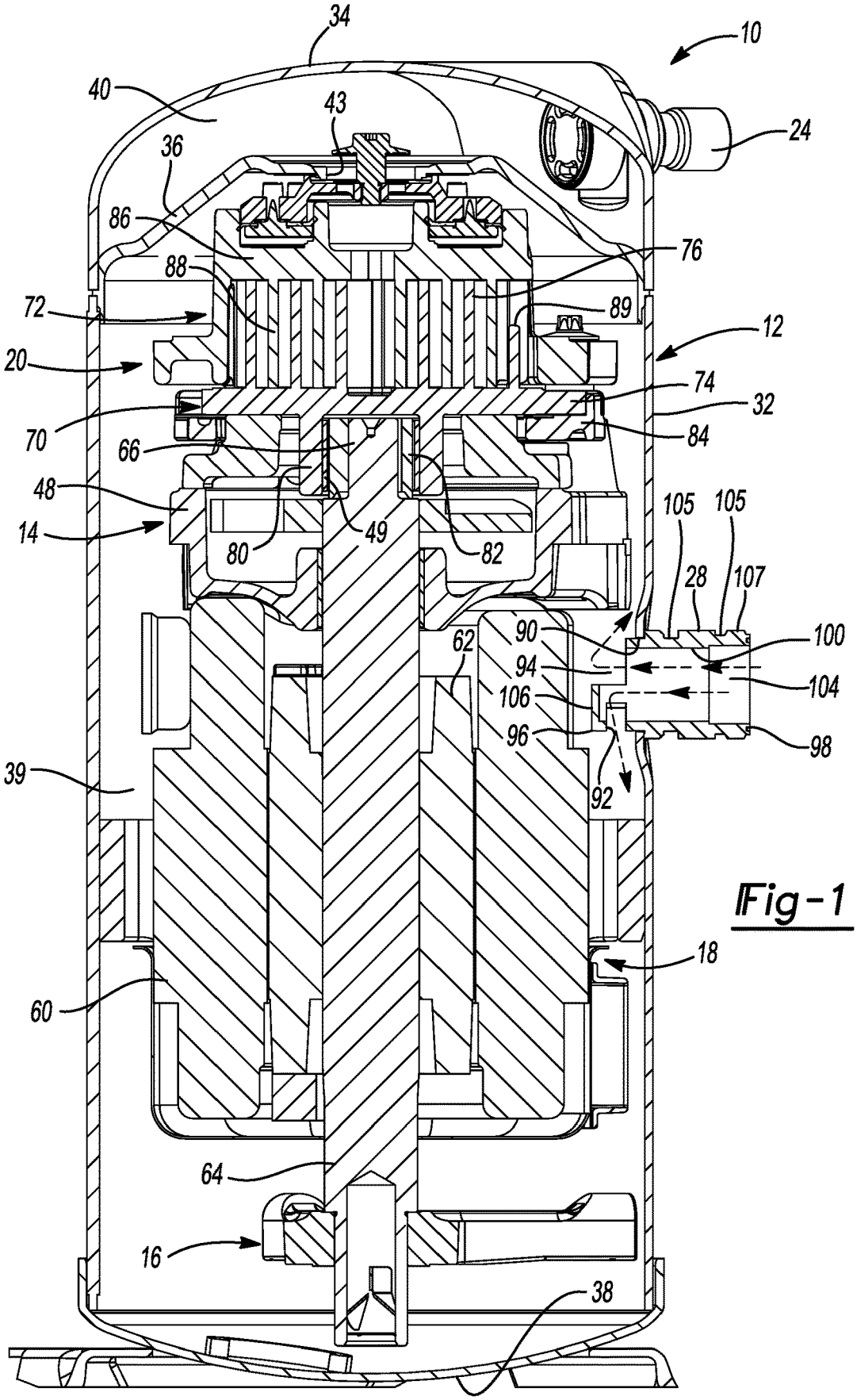
FIG. 1 is a cross-sectional view of a compressor having a suction fitting according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided and may include a hermetic shell assembly 12, first and second bearing housing assemblies 14, 16, a motor assembly 18, a compression mechanism 20, a discharge port or fitting 24 and a suction port or fitting 28.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32 and the base 38 may cooperate to define a suction-pressure chamber 39. The end cap 34 and the partition 36 may define a discharge-pressure chamber 40. The partition 36 may separate the discharge-pressure chamber 40 from the suction-pressure chamber 39. A discharge-pressure passage 43 may extend through the partition 36 to provide communication between the compression mechanism 20 and the discharge-pressure chamber 40.

As shown in FIG. 1, the first bearing housing assembly 14 may be disposed within the suction-pressure chamber 39 and may be fixed relative to the shell 32. The first bearing housing assembly 14 may include a first main bearing housing 48 and a first bearing 49. The first main bearing housing 48 may house the first bearing 49 therein. The first main bearing housing 48 may fixedly engage the shell 32 and may axially support the compression mechanism 20.

As shown in FIG. 1, the motor assembly 18 may be disposed within the suction-pressure chamber 39 and may include a stator 60 and a rotor 62. The stator 60 may be press fit into the shell 32. The rotor 62 may be press fit on a drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat.

Figure 2:
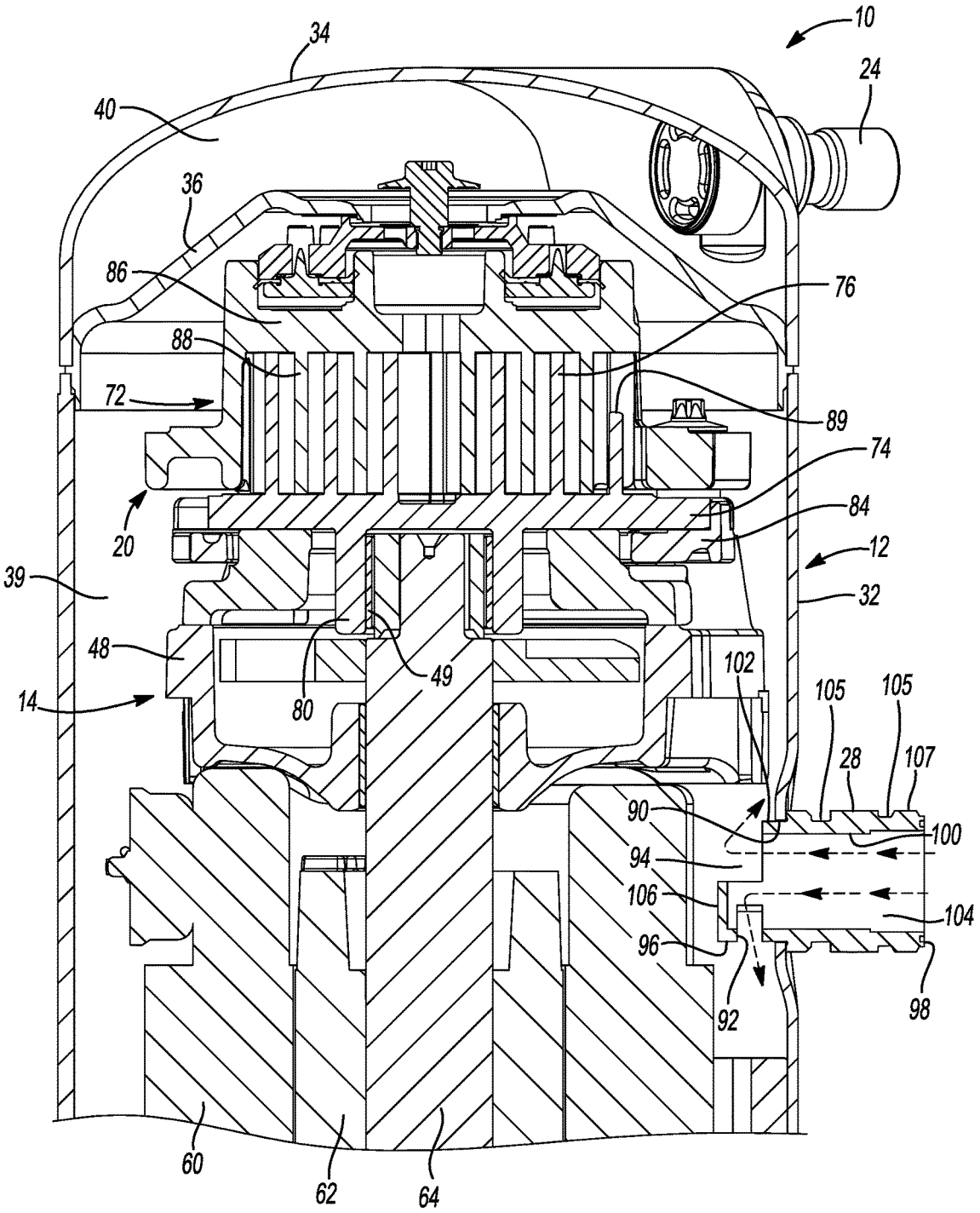
FIG. 2 is a partial cross-sectional view of the compressor of FIG. 1.
Figure 3:
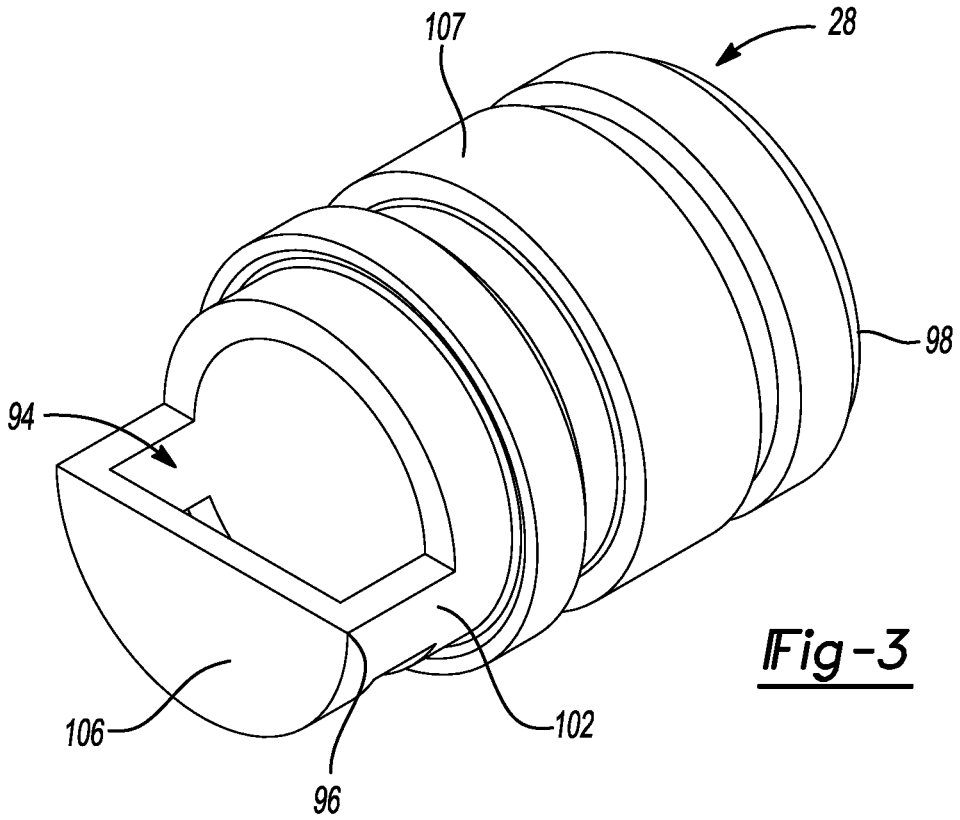
FIG. 3 is a perspective view of the suction fitting of FIG. 1.

As shown in FIGS. 1 and 2, the compression mechanism 20 may be disposed within the suction-pressure chamber 39 and may include an orbiting scroll 70 and a non-orbiting scroll 72. The first scroll member or orbiting scroll 70 may include an end plate 74 and a spiral wrap 76 extending therefrom. A cylindrical hub 80 may project downwardly from the end plate 74 and may include a drive bearing 82 and an unloader bushing 83 disposed therein. The drive bearing 82 may include an inner bore (not numbered) in which the crank pin 66 is drivingly disposed. The crank pin flat may drivingly engage a flat surface in a portion of the inner bore to provide a radially compliant driving arrangement. An Oldham coupling 84 may be engaged with the orbiting scroll 70 and the bearing housing 48 to prevent relative rotation therebetween.

As shown in FIGS. 1 and 2, the second scroll member or non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20.

As shown in FIGS. 1-4, the suction fitting 28 may be a single, unitary component. The suction fitting 28 may direct a portion of working fluid at a suction-pressure from the suction fitting 28 to a suction inlet 89 of the non-orbiting scroll 72 so that the portion of working fluid can be directed into the radially outermost fluid pocket and subsequently compressed by the compression mechanism 20. The suction fitting 28 may also direct a portion of working fluid at a suction-pressure from the suction fitting 28 to the motor assembly 18 to cool the motor assembly 18. The suction fitting 28 may be generally cylindrical and may be made of a metallic or polymeric material, for example. The suction fitting 28 may be attached to the shell 32 at an opening 90 thereof (FIGS. 1 and 2) and may also extend at least partially into the suction-pressure chamber 39. The suction fitting 28 may be axially misaligned with the suction inlet 89 of the non-orbiting scroll 72. For example, the suction fitting 28 may be disposed vertically lower than the suction inlet 89.

Figure 4:
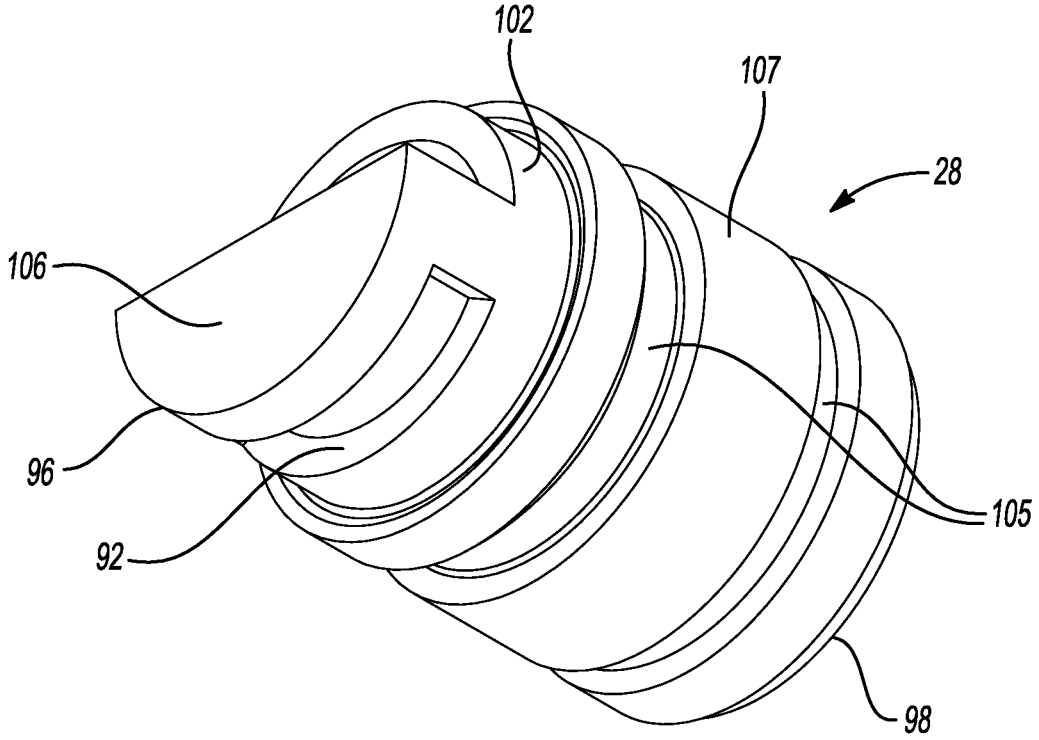
FIG. 4 is another perspective view of the suction fitting of FIG. 1.

The suction fitting 28 may include an elongated slot 92 and an opening 94 formed therein. As shown in FIG. 4, the elongated slot 92 may be arcuate and may be rectangularly-shaped. The elongated slot 92 may be machined in the suction fitting 28, for example. The elongated slot 92 may be formed between axial ends 96, 98 of the suction fitting 28 and may extend radially through inner and outer diametrical surfaces 100, 102 of the suction fitting 28 (FIGS. 1 and 2). The elongated slot 92 may face toward the base 38 of the shell assembly 12. In this manner, a portion of working fluid flowing through a passage 104 of the suction fitting 28 and out the elongated slot 92 is directed toward the motor assembly 18 to cool the motor assembly 18, for example, and/or other components disposed within the suction-pressure chamber 39.

The opening 94 may be machined in the suction fitting 28, for example. The opening 94 may be formed at the axial end 96 of the suction fitting 28 (i.e., the axial end 96 that extends into the suction-pressure chamber 39) and may face at least partially toward the end cap 34 of the shell assembly 12 (FIGS. 1 and 2). In this manner, a portion of working fluid flowing through the passage 104 of the suction fitting 28 may be directed out of the opening 94 and toward the suction inlet 89 of the non-orbiting scroll 72 so that the portion of working fluid can be directed into the radially outermost fluid pocket and subsequently compressed by the compression mechanism 20. The opening 94 may allow a greater volume of working fluid therethrough than the elongated slot 92. In this way, a greater volume of working fluid flowing through the passage 104 of the suction fitting 28 flows out of the opening 94 than the elongated slot 92. A plurality of slots 105 may be formed in an outer diametrical surface 107 of the suction fitting 28.

The suction fitting 28 may also include an axial end wall 106 that may deflect a portion of working fluid flowing through the suction fitting 28 towards the opening 94 and the slot 92. The axial end wall 106 may be flat and may have a semi-circular shape. In some configurations, a plate (not shown) may be coupled to the suction fitting 28 within the passage 104 and may deflect working fluid toward the slot 92 and the opening 94. In some configurations, the plate may be made of a thermally responsive material such that it deflects more or less working fluid toward one of the slot 92 and the opening 94 than the other of the slot 92 and the opening 94 based at least partially on the operating conditions of various components of the compressor 10 (e.g., the compression mechanism 20 and/or the motor assembly 18 and/or the suction gas temperature).

It should be understood that the suction fitting 28 may be attached to the shell 32 at various angular orientations based at least partially on the design specifications of the compressor 10. For example, the suction fitting 28 may be attached to the shell 32 such that the elongated slot 92 faces toward the end cap 34 of the shell assembly 12 and the opening 94 faces at least partially toward the base 38 of the shell assembly 12 (e.g., rotated 180 degrees relative to the orientation shown in FIGS. 1 and 2). In this manner, a greater volume of working fluid flowing through the passage 104 of the suction fitting 28 is directed toward the motor assembly 18 (i.e., out of the opening 94) than toward the compression mechanism 20 (i.e., out of the elongated slot 92).

The suction fitting 28 of the present disclosure provides the benefit of being able to deflect or direct working fluid toward various components of the compressor 10 (e.g., motor assembly 18 and/or compression mechanism 20) as oppose to having a separate deflector that is attached to the shell 32 or the first bearing housing assembly 14, for example. In this way, time and cost required to assemble the compressor 10 is reduced. The suction fitting 28 of the present disclosure also provides the benefit of attaching the suction fitting 28 to the shell 32 at various angular orientations depending on the design specifications of the compressor 10. In this manner, efficient and effective operation of the compressor 10 is achieved.

It should be understood that the suction fitting 28 of the present disclosure may also be used in other types of compressors (e.g., reciprocating compressors, centrifugal compressors, rotary vane compressors, etc.).

Figure 5:
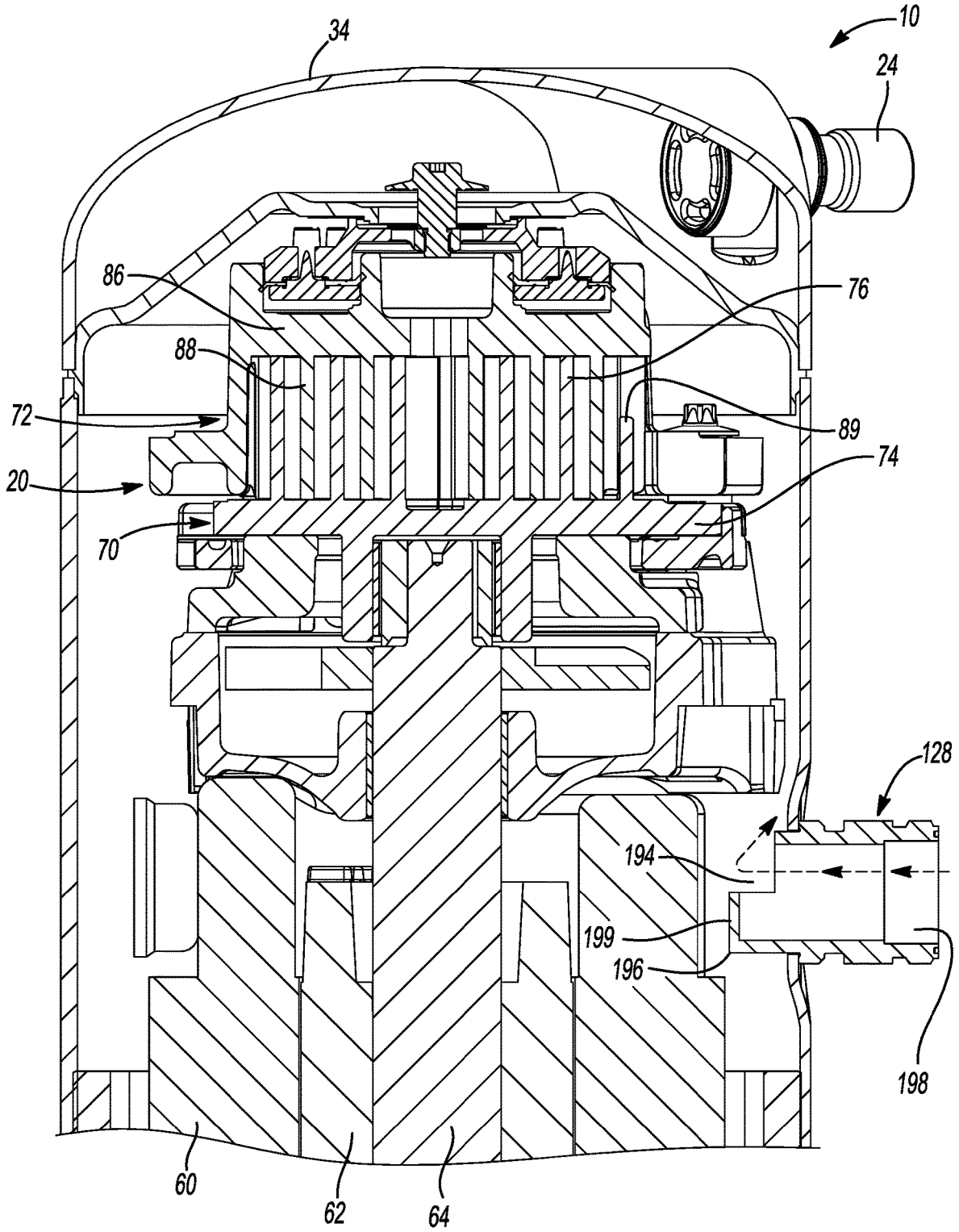
FIG. 5 is a partial cross-sectional view of the compressor having an alternate suction fitting.
Figure 6:
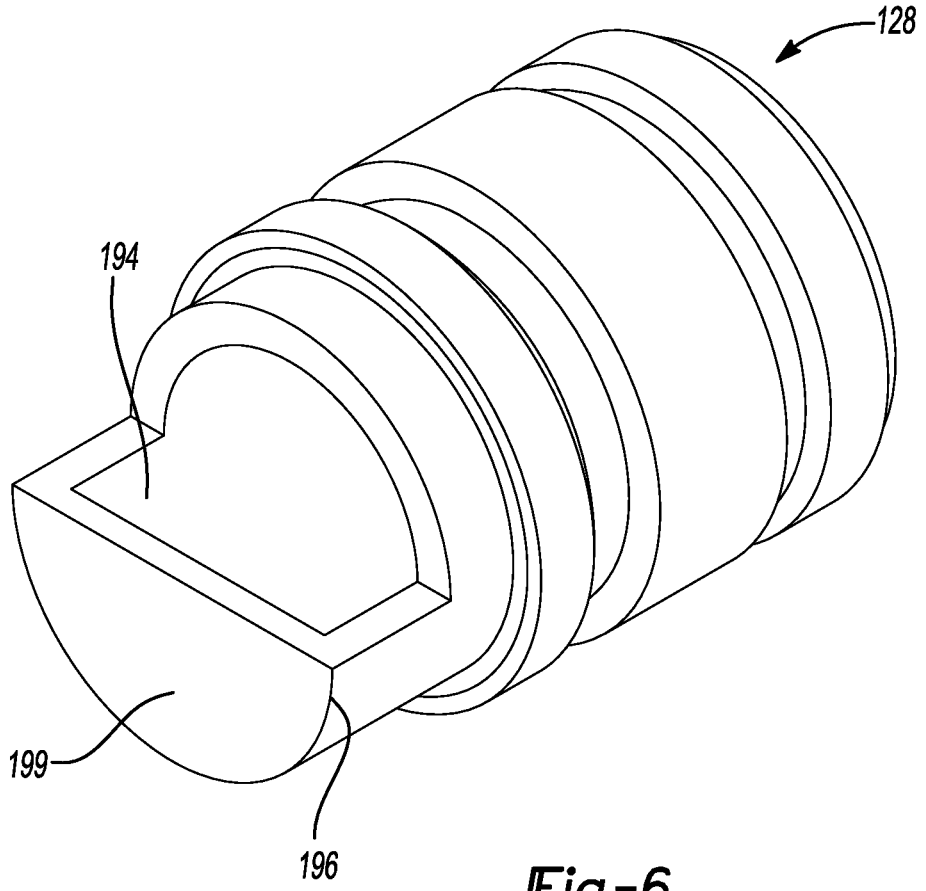
FIG. 6 is a perspective view of the suction fitting of FIG. 5.

With reference to FIGS. 5 and 6, another suction fitting 128 is provided. The suction fitting 128 may be incorporated into the compressor 10 instead of the suction fitting 28. The structure and function of the suction fitting 128 may be similar or identical to that of the suction fitting 28 described above, apart from any exception noted below.

The suction fitting 128 may be a single, unitary component. The suction fitting 128 may direct working fluid at a suction-pressure from the suction fitting 128 to the suction inlet 89 of the non-orbiting scroll 72 so that the working fluid can be directed into the radially outermost fluid pocket and subsequently compressed by the compression mechanism 20. The suction fitting 128 may be generally cylindrical and may be made of a metallic or polymeric material, for example. The suction fitting 128 may be attached to the shell 32 at the opening 90 thereof and may also extend at least partially into the suction-pressure chamber 39.

As shown in FIGS. 5 and 6, the suction fitting 128 may include an opening 194 formed therein. The opening 194 may be machined in the suction fitting 128, for example. The opening 194 may be formed at an axial end 196 of the suction fitting 128 (i.e., the axial end 196 that extends into the suction-pressure chamber 39) and may face at least partially toward the end cap 34 of the shell assembly 12. In this manner, working fluid flowing through a passage 198 of the suction fitting 128 and out of the opening 194 is directed toward the suction inlet 89 of the non-orbiting scroll 72 so that the working fluid can be directed into the radially outermost fluid pocket and subsequently compressed by the compression mechanism 20.

The suction fitting 128 may also include an axial end wall 199 that may deflect a portion of working fluid flowing through the suction fitting 128 towards the opening 194. The axial end wall 199 may be flat and may have a semi-circular shape. It should be understood that the suction fitting 128 may be attached to the shell 32 at various angular orientations based at least partially on the design specifications of the compressor 10. For example, the suction fitting 128 may be attached to the shell 32 such that the opening 194 faces at least partially toward the base 38 of the shell assembly 12 (e.g., rotated 180 degrees relative to the orientation shown in FIG. 5).

Figure 7:
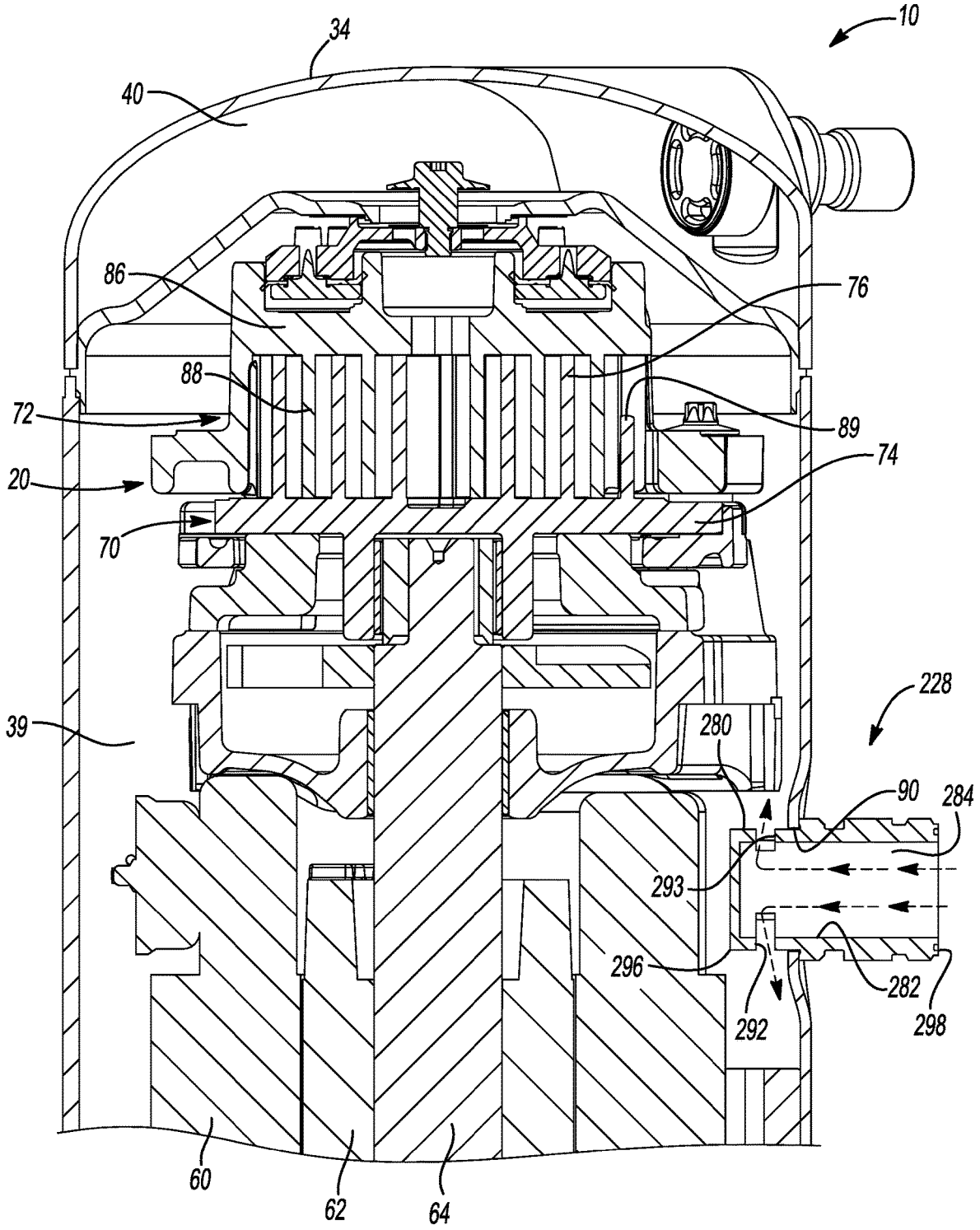
FIG. 7 is a partial cross-sectional view of the compressor having yet another alternate suction fitting.
Figure 8:
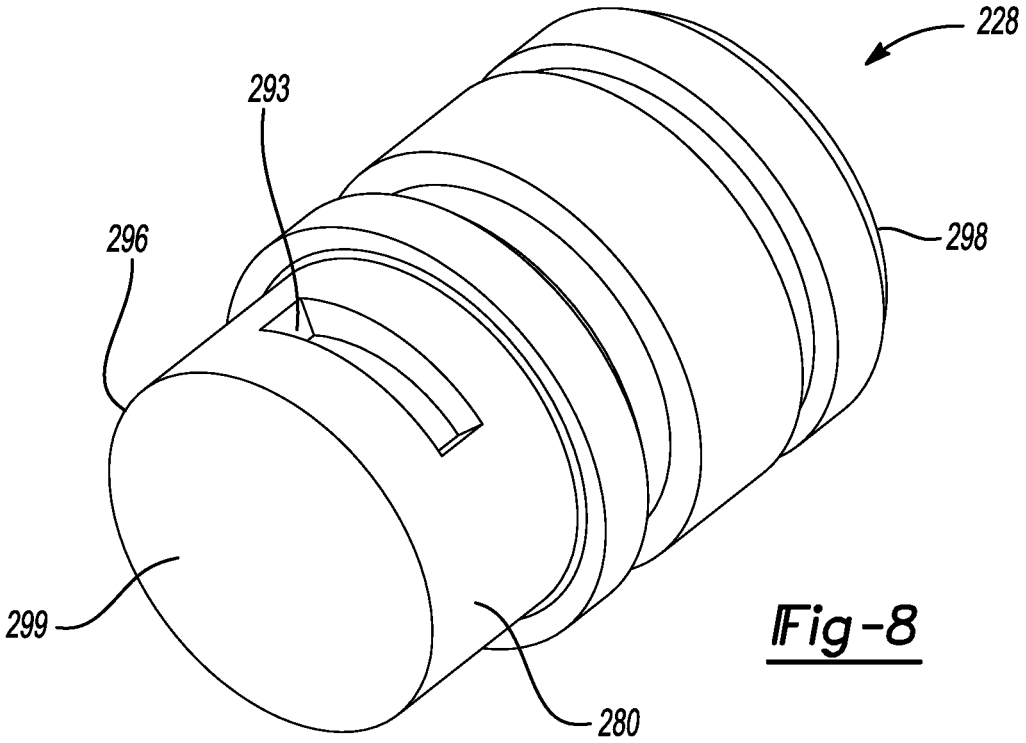
FIG. 8 is a perspective view of the suction fitting of FIG. 7.
Figure 9:
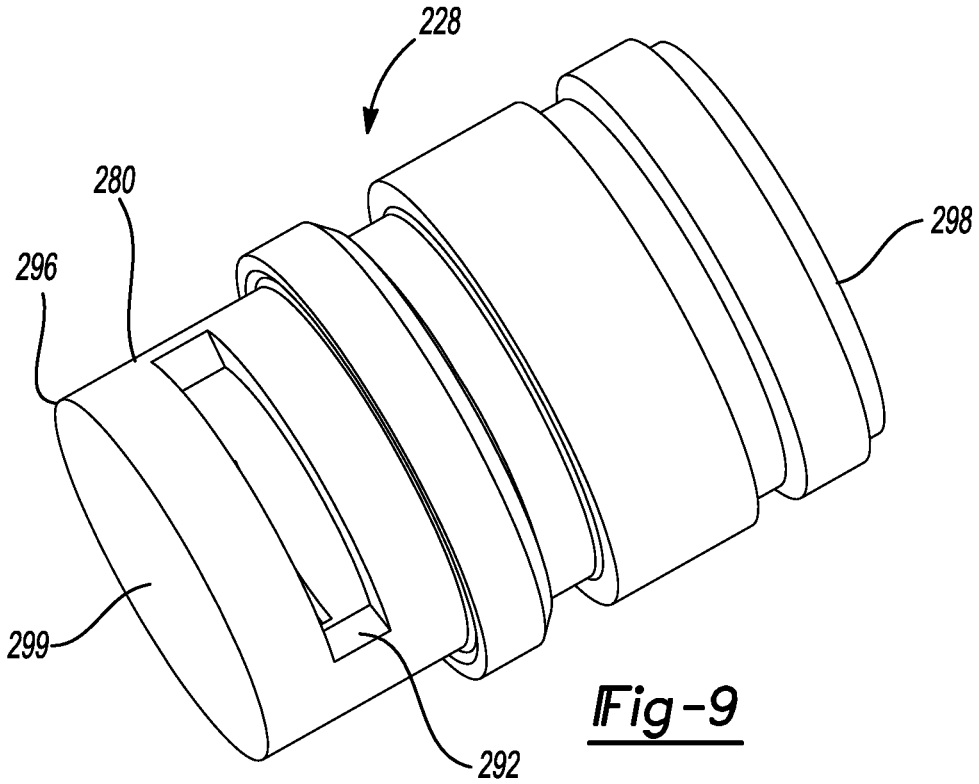
FIG. 9 is another perspective view of the suction fitting of FIG. 7.

With reference to FIGS. 7-9, another suction fitting 228 is provided. The suction fitting 228 may be incorporated into the compressor 10 instead of the suction fittings 28, 128. The structure and function of the suction fitting 228 may be similar or identical to that of the suction fittings 28, 128 described above, apart from any exception noted below.

The suction fitting 228 may be a single, unitary component. The suction fitting 228 may direct a portion of working fluid at a suction-pressure from the suction fitting 228 to the suction inlet 89 of the non-orbiting scroll 72 so that the portion of working fluid can be directed into the radially outermost fluid pocket and subsequently compressed by the compression mechanism 20. The suction fitting 228 may also direct a portion of working fluid at a suction-pressure from the suction fitting 228 to the motor assembly 18 to cool the motor assembly 18. The suction fitting 228 may be generally cylindrical and may be made of a metallic or polymeric material, for example. As shown in FIG. 7, the suction fitting 228 may be attached to the shell 32 at the opening 90 thereof and may also extend at least partially into the suction-pressure chamber 39.

With reference to FIGS. 7-9, the suction fitting 228 may include a first elongated slot 292 (FIGS. 7 and 9) and a second elongated slot 293 (FIGS. 7 and 8) formed therein. The first elongated slot 292 may be arcuate and may be rectangularly-shaped. The first elongated slot 292 may be machined in the suction fitting 228, for example. The first elongated slot 292 may be formed between axial ends 296, 298 of the suction fitting 228 and may extend radially through inner and outer diametrical surfaces 280, 282 of the suction fitting 228. The first elongated slot 292 may face toward the base 38 of the shell assembly 12. In this manner, a portion of working fluid flowing through a passage 284 of the suction fitting 228 and out the first elongated slot 292 is directed toward the motor assembly 18 to cool the motor assembly 18.

As shown in FIG. 8, the second elongated slot 293 may be arcuate and may be rectangularly-shaped. The second elongated slot 293 may be machined in the suction fitting 228, for example. The second elongated slot 293 may be formed between the axial ends 296, 298 of the suction fitting 228 and may extend radially through the inner and outer diametrical surfaces 280, 282 of the suction fitting 228. The second elongated slot 293 may face toward the end cap 34 of the shell assembly 12. In this manner, a portion of working fluid flowing through the passage 284 of the suction fitting 228 and out of the second elongated slot 293 is directed toward the suction inlet 89 of the non-orbiting scroll 72 so that the portion of working fluid can be directed into the radially outermost fluid pocket and subsequently compressed by the compression mechanism 20. The first slot 292 may have a length that is longer than a length of the second slot 293. In this way, the first slot 292 may allow a greater volume of working fluid therethrough than the second elongated slot 293. That is, a greater volume of working fluid flowing through the passage 284 of the suction fitting 228 is directed toward the motor assembly 18 (i.e., out of the first elongated slot 292) than toward the compression mechanism 20 (i.e., out of the second elongated slot 293).

The suction fitting 228 may also include an axial end wall 299 that may deflect a portion of working fluid flowing through the suction fitting 228 towards the first and second elongated slots 292, 293. The axial end wall 299 may be flat.

It should be understood that the suction fitting 228 may be attached to the shell 32 at various angular orientations based at least partially on the design specifications of the compressor 10. For example, the suction fitting 228 may be attached to the shell 32 such that the first elongated slot 292 faces toward the end cap 34 of the shell assembly 12 and the second elongated slot 293 faces toward the base 38 of the shell assembly 12 (e.g., rotated 180 degrees relative to the orientation shown in FIG. 7). In this manner, a greater volume of working fluid flowing through the passage 284 of the suction fitting 228 is directed toward the compression mechanism 20 (i.e., out of the first elongated slot 292) than toward the motor assembly 18 (i.e., out of the second elongated slot 293).

In another example, the suction fitting 228 may be attached to the shell 32 such that the first elongated slot 292 faces toward the shell 32 of the shell assembly 12 and the second elongated slot 293 faces toward the shell 32 of the shell assembly 12 (e.g., rotated 90 degrees relative to the orientation shown in FIG. 7). In this manner, working fluid flowing through the passage 284 of the suction fitting 228 flows equally toward the compression mechanism 20 and the motor assembly 18 (i.e., out of the first and second elongated slots 292, 293).

Figure 10:
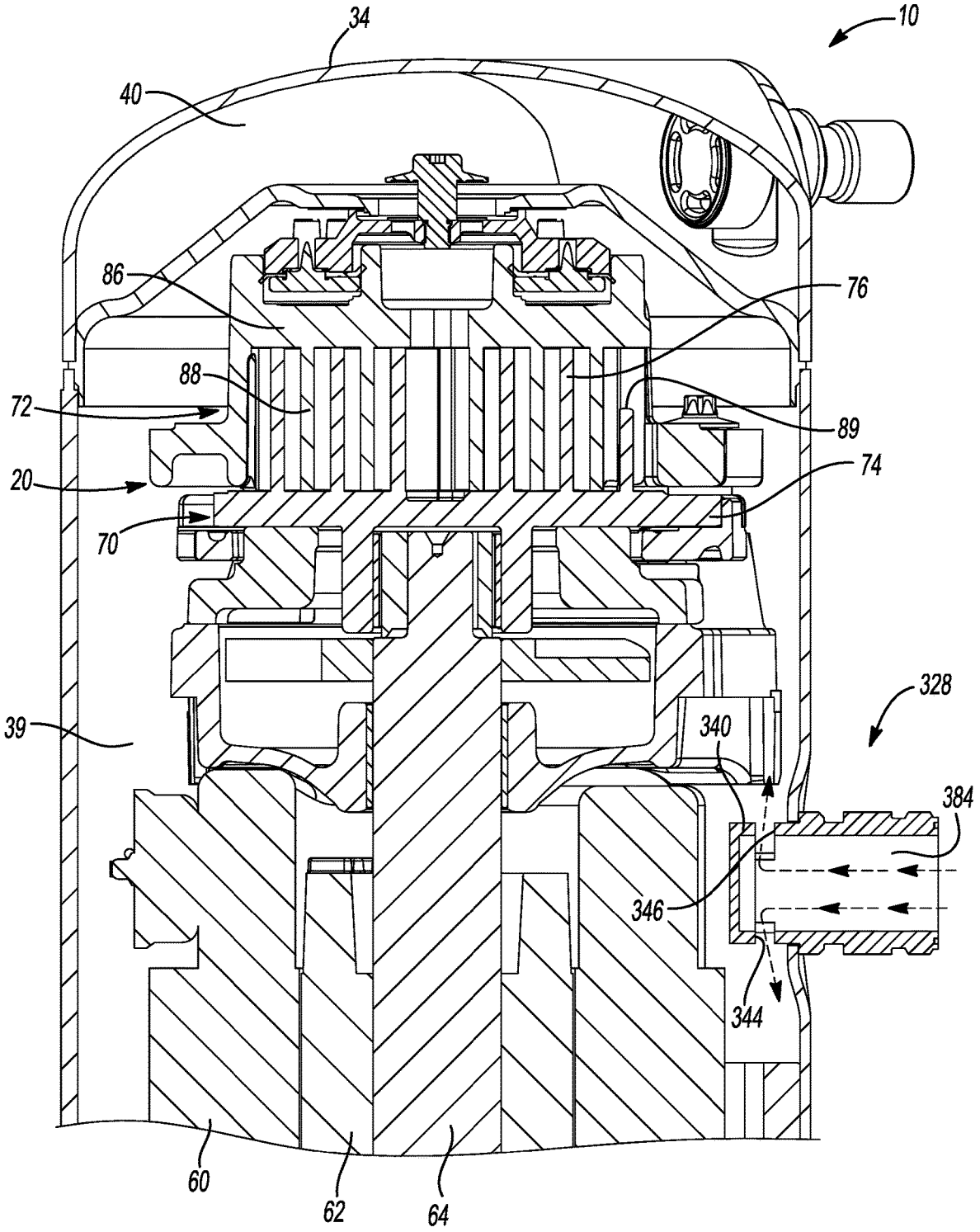
FIG. 10 is a partial cross-sectional view of the compressor having yet another alternate suction fitting.
Figure 11:
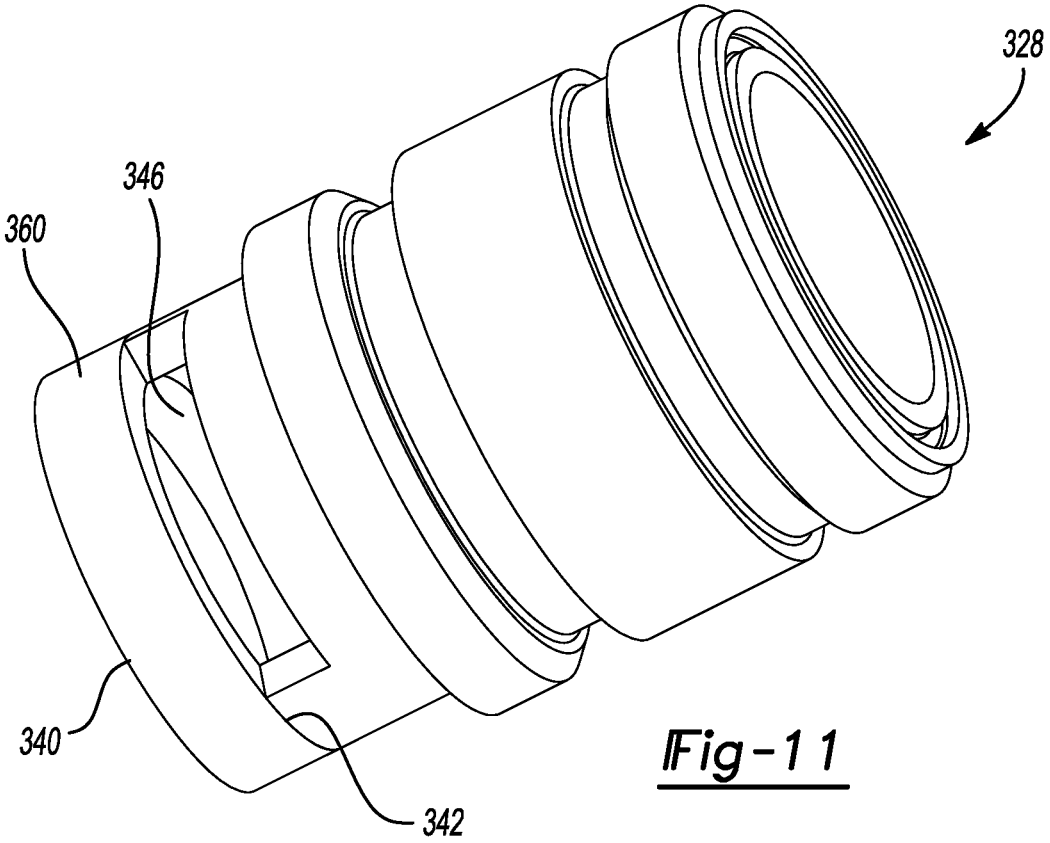
FIG. 11 is a perspective view of the suction fitting of FIG. 10.
Figure 12:
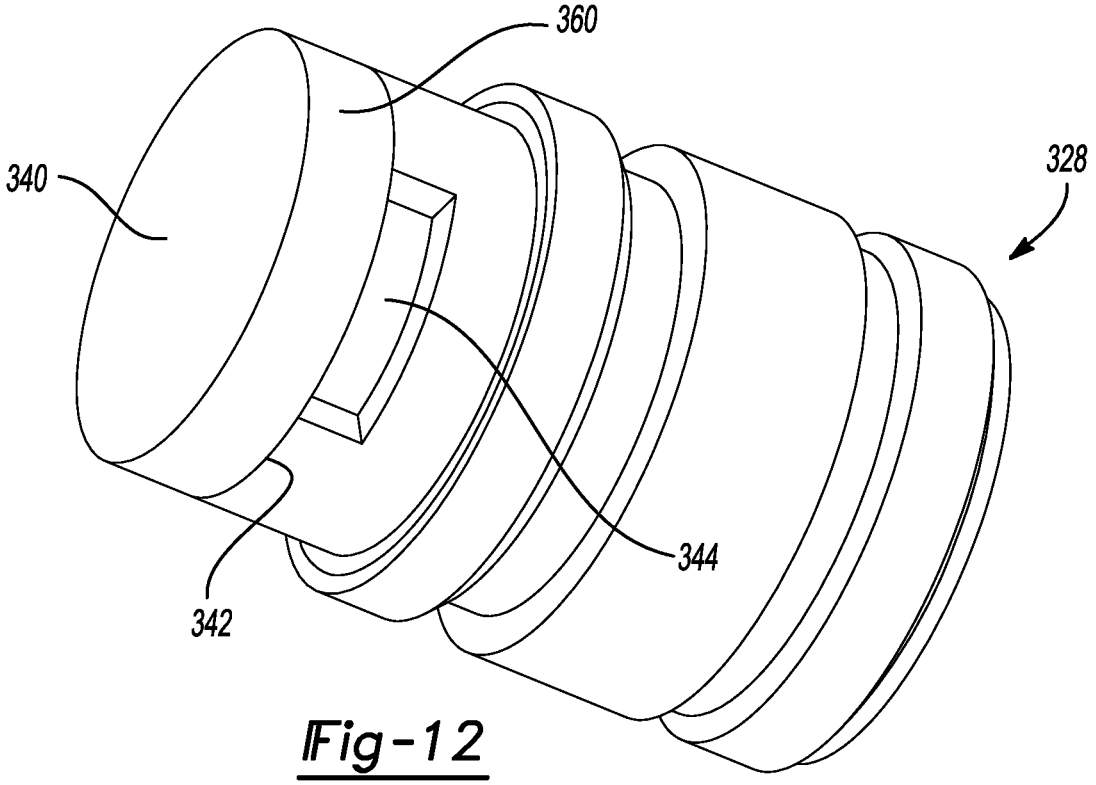
FIG. 12 is another perspective view of the suction fitting of FIG. 10.

With reference to FIGS. 10-12, another suction fitting 328 is provided. The suction fitting 328 may be incorporated into the compressor 10 instead of the suction fittings 28, 128, 228. The structure and function of the suction fitting 328 may be similar or identical to that of the suction fittings 28, 128, 228 described above, apart from any exception noted below.

The suction fitting 328 may direct a portion of working fluid at a suction-pressure from the suction fitting 328 to the suction inlet 89 of the non-orbiting scroll 72 so that the portion of working fluid can be directed into the radially outermost fluid pocket and subsequently compressed by the compression mechanism 20. The suction fitting 328 may also direct a portion of working fluid at a suction-pressure from the suction fitting 328 to the motor assembly 18 to cool the motor assembly 18. The suction fitting 328 may be generally cylindrical and may be made of a metallic or polymeric material, for example. As shown in FIG. 10, the suction fitting 328 may be attached to the shell 32 at the opening 90 thereof and may also extend at least partially into the suction-pressure chamber 39.

An annular base plate 340 may be made out of metallic material, for example, and may be attached to (e.g., welded, press-fit, etc.) an axial end 342 of the suction fitting 328 (FIGS. 10-12; the axial end 342 that extends at least partially into the suction-pressure chamber 39). In this way, the base plate 340 and the suction fitting 328 may cooperate to define a first elongated opening or slot 344 and a second elongated opening or slot 346.

The first elongated opening 344 may be arcuate and may be rectangularly-shaped. The first elongated opening 344 may face toward the base 38 of the shell assembly 12. In this manner, a portion of working fluid flowing through a passage 384 of the suction fitting 328 and out the first elongated opening 344 is directed toward the motor assembly 18 to cool the motor assembly 18.

As shown in FIG. 11, the second elongated opening 346 may be arcuate and may be rectangularly-shaped. The second elongated opening 346 may face toward the end cap 34 of the shell assembly 12. In this manner, a portion of working fluid flowing through the passage 384 of the suction fitting 328 and out of the second elongated opening 346 is directed toward the suction inlet 89 of the non-orbiting scroll 72 so that the portion of working fluid can be directed into the radially outermost fluid pocket and subsequently compressed by the compression mechanism 20. The second opening 346 may have a length that is longer than a length of the first opening 344. In this way, the second opening 346 may allow a greater volume of working fluid therethrough than the first opening 344. That is, a greater volume of working fluid flowing through the passage 384 of the suction fitting 328 is directed toward the compression mechanism 20 (i.e. out of the second elongated opening 346) than directed toward the motor assembly 18 (i.e., out of the first elongated opening 344). The base plate 340 may deflect a portion of working fluid flowing through the suction fitting 328 towards the first and second elongated openings 344, 346.

In some configurations, one or more openings (not shown) may be formed in the base plate 340 (e.g., the one or more openings may be formed in an outer diametrical surface 360 of the base plate 340). In this way, working fluid flowing through the passage 384 of the suction fitting 328 may be directed toward the motor assembly 18 and the compression mechanism 20 via the one or more openings.

Figure 13:
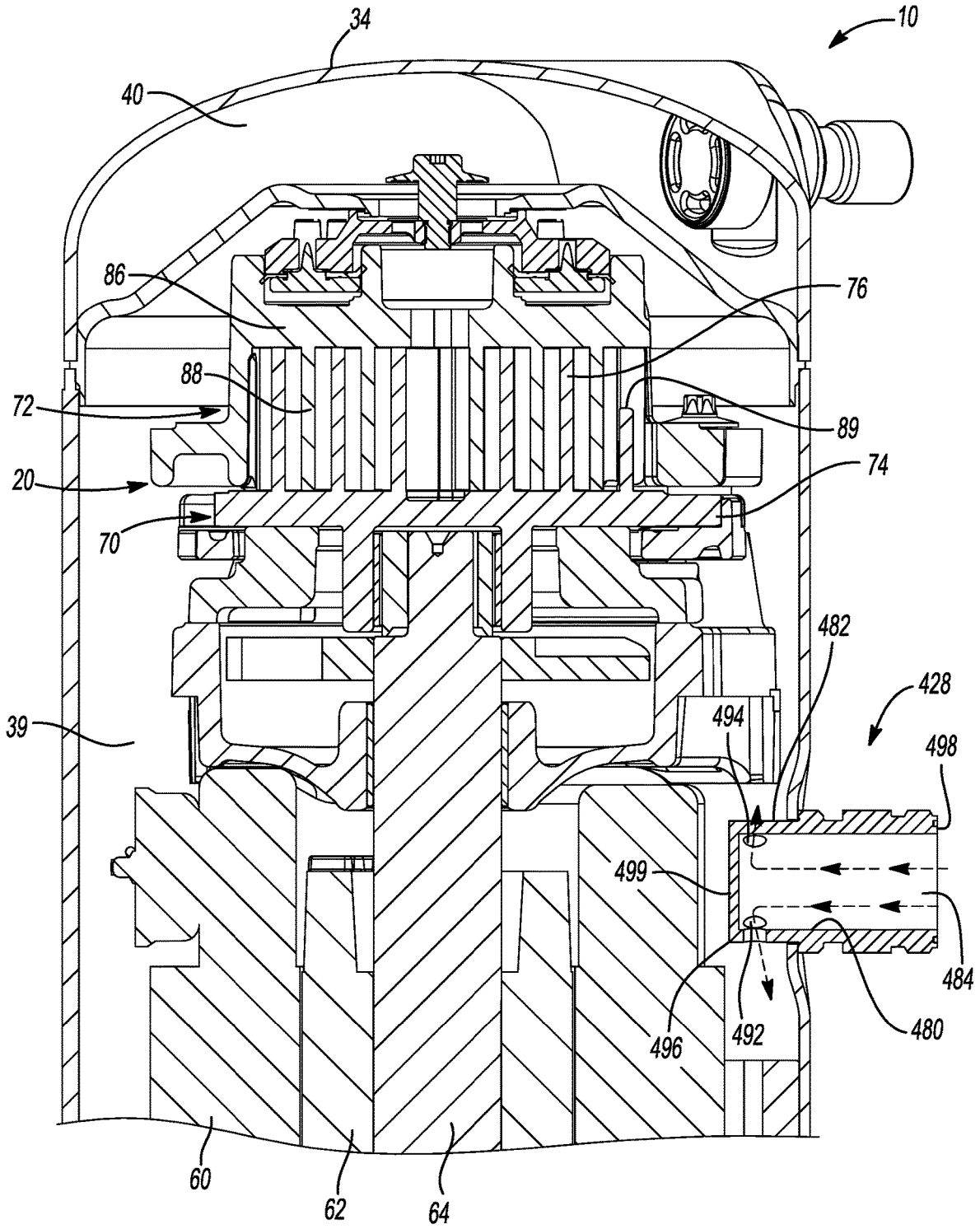
FIG. 13 is a partial cross-sectional view of the compressor having yet another alternate suction fitting.
Figure 14:
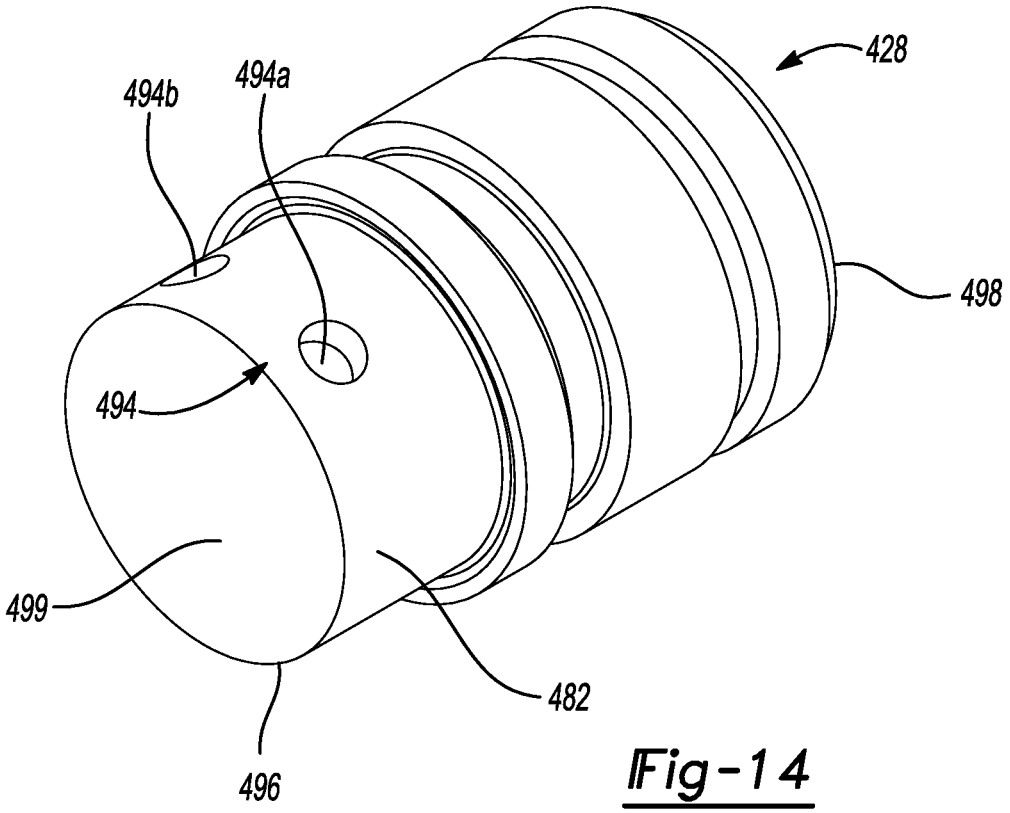
FIG. 14 is a perspective view of the suction fitting of FIG. 13.
Figure 15:
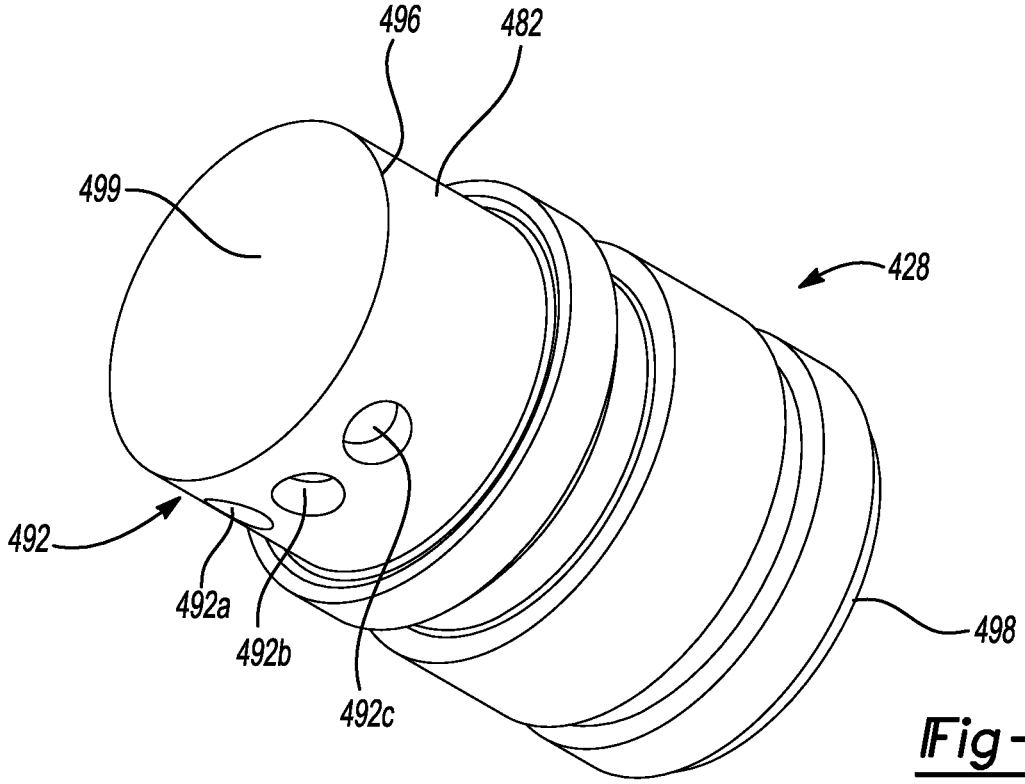
FIG. 15 is another perspective view of the suction fitting of FIG. 13.

With reference to FIGS. 13-15, another suction fitting 428 is provided. The suction fitting 428 may be incorporated into the compressor 10 instead of the suction fittings 28, 128, 228, 328. The structure and function of the suction fitting 428 may be similar or identical to that of the suction fittings 28, 128, 228, 328 described above, apart from any exception noted below.

The suction fitting 428 may direct a portion of working fluid at a suction-pressure from the suction fitting 428 to the suction inlet 89 of the non-orbiting scroll 72 so that the portion of working fluid can be directed into the radially outermost fluid pocket and subsequently compressed by the compression mechanism 20. The suction fitting 428 may also direct a portion of working fluid at a suction-pressure from the suction fitting 428 to the motor assembly 18 to cool the motor assembly 18. The suction fitting 428 may be generally cylindrical and may be made of a metallic or polymeric material, for example. As shown in FIG. 13, the suction fitting 428 may be attached to the shell 32 at the opening 90 thereof and may also extend at least partially into the suction-pressure chamber 39.

The suction fitting 428 may include a plurality of first apertures 492 (FIG. 15; comprised of aperture 492*a*, aperture 492*b* and aperture 492*c*) and a plurality second apertures 494 (FIG. 14; comprised of aperture 494*a* and aperture 494*b*) formed therein. The first apertures 492 may be circular-shaped and may be machined in the suction fitting 428, for example. The first apertures 492 may be formed between axial ends 496, 498 of the suction fitting 428 and may extend radially through inner and outer diametrical surfaces 480, 482 of the suction fitting 428. The first apertures 492 may be aligned with each other and may face toward the base 38 of the shell assembly 12. In this manner, a portion of working fluid flowing through a passage 484 of the suction fitting 428 and out the first apertures 492 is directed toward the motor assembly 18 to cool the motor assembly 18.

The second apertures 494 may be circular-shaped and may be machined in the suction fitting 428, for example. The second apertures 494 may be formed between the axial ends 496, 498 of the suction fitting 428 and may extend radially through the inner and outer diametrical surfaces 480, 482 of the suction fitting 428. The second apertures 494 may be aligned with each other and may face toward the end cap 34 of the shell assembly 12. In this manner, a portion of working fluid flowing through the passage 484 of the suction fitting 428 and out of the second apertures 494 is directed toward the suction inlet 89 of the non-orbiting scroll 72 so that the portion of working fluid can be directed into the radially outermost fluid pocket and subsequently compressed by the compression mechanism 20. A greater volume of working fluid flowing through the passage 484 may be directed toward the motor assembly 18 than directed toward the compression mechanism 20 due to the suction fitting 428 having more first apertures 492 than second apertures 494.

As shown in FIGS. 13-15, the suction fitting 428 may also include an axial end wall 499 that may deflect a portion of working fluid flowing through the suction fitting 428 towards the first and second apertures 492, 494.

With reference to FIGS. 16-20, a suction fitting assembly 528 is provided. The suction fitting assembly 528 may be incorporated into the compressor 10 instead of the suction fittings 28, 128, 228, 328, 428.

The suction fitting assembly 528 may allow a portion of working fluid at a suction-pressure to flow from the suction fitting assembly 528 to the suction inlet 89 of the non-orbiting scroll 72 so that the portion of working fluid can be directed into the radially outermost fluid pocket and subsequently compressed by the compression mechanism 20. The suction fitting assembly 528 may also direct a portion of working fluid at a suction-pressure from the suction fitting assembly 528 to the motor assembly 18 to cool the motor assembly 18.

The suction fitting assembly 528 may include a suction fitting 530 and a deflector 532. The structure and function of the suction fitting 530 may be similar or identical to that of the suction fittings 28, 128, 228, 328, 428 described above, apart from any exception noted below.

Figure 16:
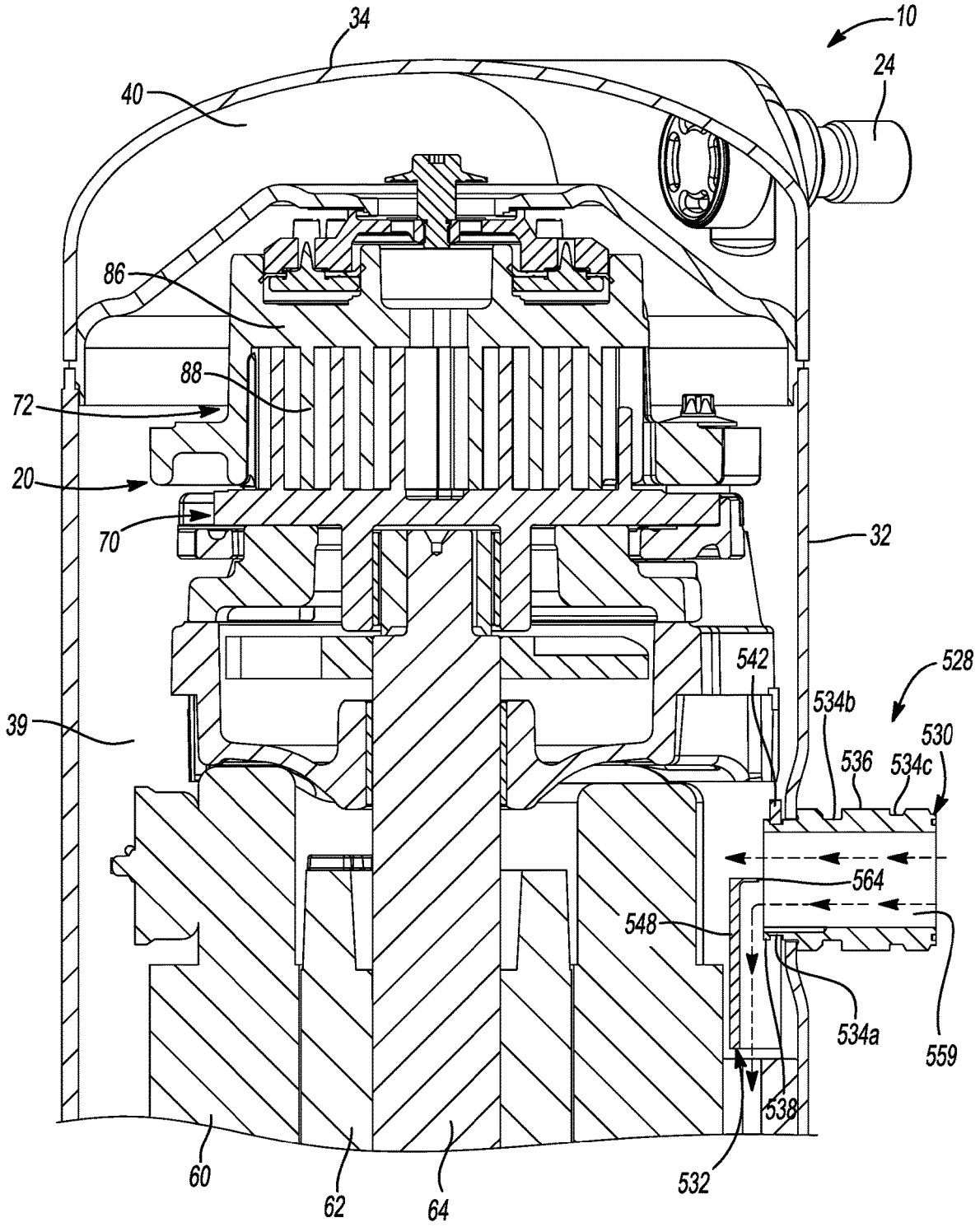
FIG. 16 is a partial cross-sectional view of the compressor having yet another alternate suction fitting assembly.

The suction fitting 530 may be generally cylindrical and may be made of a metallic or polymeric material, for example. As shown in FIG. 16, the suction fitting 530 may be attached to the shell 32 at the opening 90 thereof. The suction fitting 530 may include a plurality of grooves 534 (comprising grooves 534*a*, 534*b*, 534*c*) formed in an outer diametrical surface 536 of the suction fitting 530. Each groove 534*a*, 534*b*, 534*c* may extend 360 degrees around the suction fitting 530.

Figure 17:
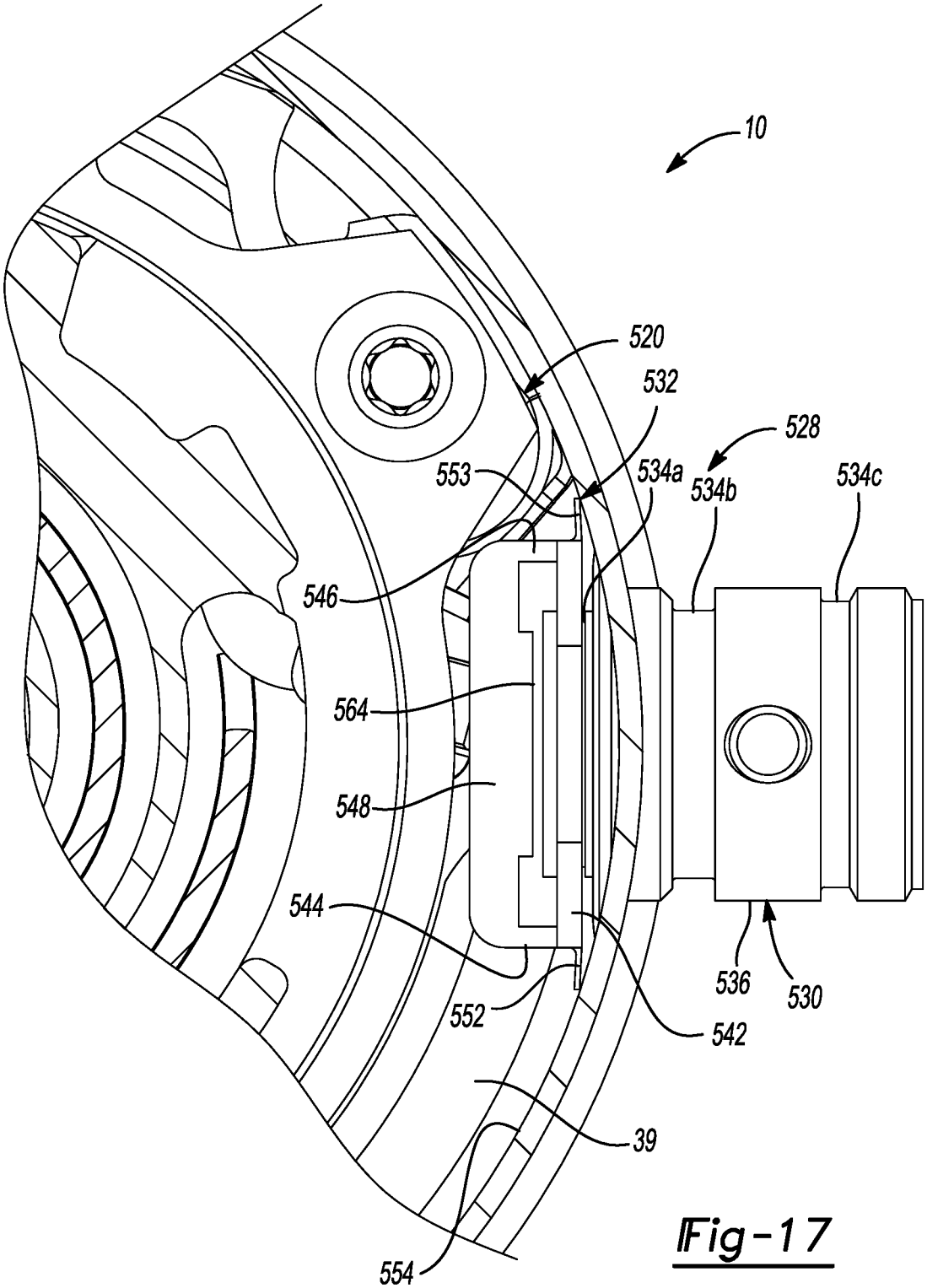
FIG. 17 is a partial cross-sectional view of the compressor of FIG. 16.
Figure 18:
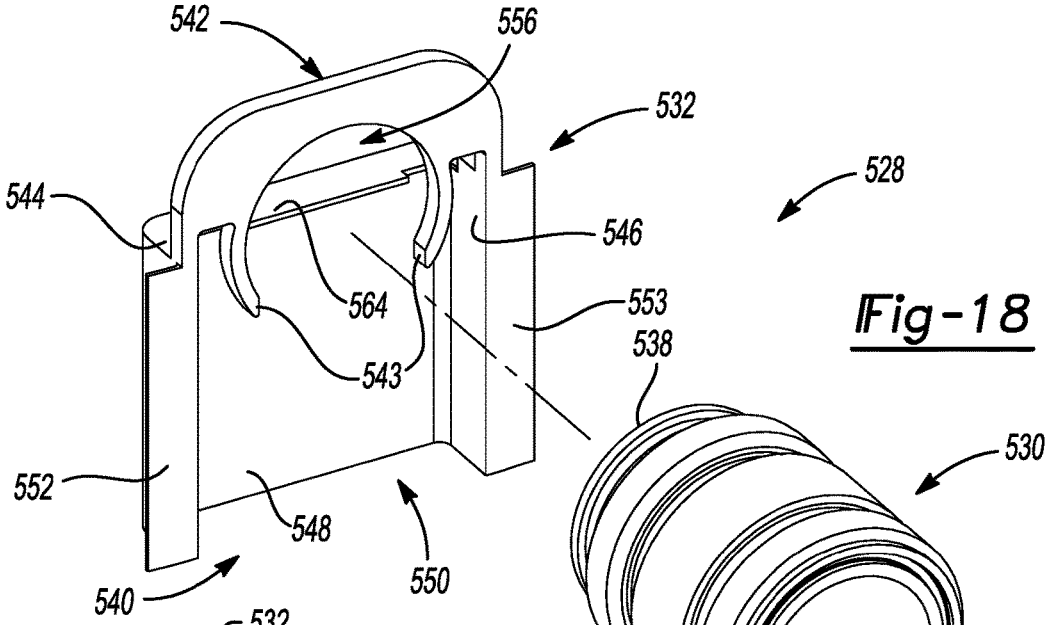
FIG. 18 is a perspective view of the suction fitting assembly of FIG. 16 with a suction fitting of the suction fitting assembly and a deflector of the suction fitting assembly disconnected from each other.
Figure 19:
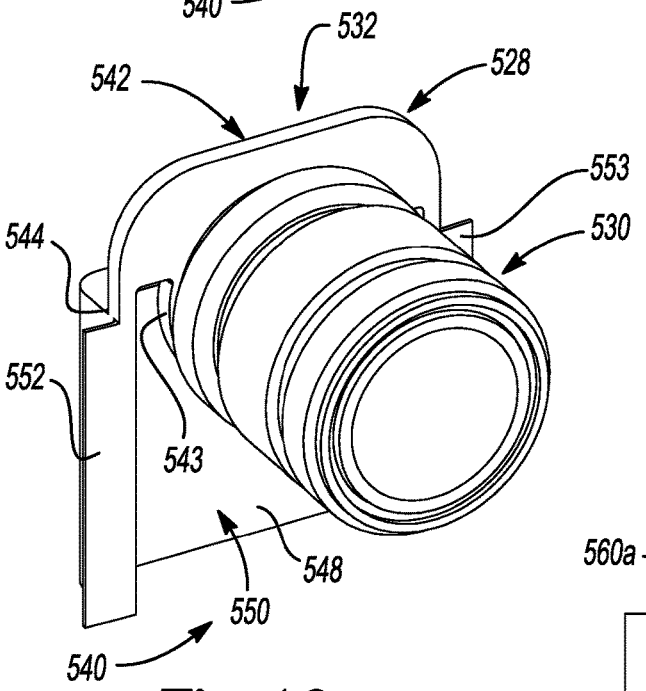
FIG. 19 is a perspective view of the suction fitting assembly of FIG. 16 with the suction fitting and the deflector connected to each other.

As shown in FIGS. 16, 17 and 19, the deflector 532 may snap into engagement with an axial end 538 of the suction fitting 530 (i.e., the axial end 538 that extends at least partially into the suction-pressure chamber 39) and may be made out of a metallic or polymeric material, for example. With reference to FIGS. 16-20, the deflector 532 may include a first body portion 540, a second body portion 542 and a plurality of resiliently flexible members 543 (FIGS. 18 and 19). The first body portion 540 may include a first wall 544, a second wall 546 and a third wall 548 that cooperate to define a channel 550. The first and second walls 544, 546 may extend perpendicularly from respective ends of the third wall 548. Resiliently flexible tabs 552, 553 may extend outwardly from first and second walls 544, 546, respectively. Once the suction fitting 530 is attached to the shell 32 and the deflector 532 snaps into engagement with the suction fitting 530, the tabs 552, 553 may contact an inner diametrical surface 554 of the shell 32 (FIG. 17) to bias the deflector 532 against the suction fitting 530.

As shown in FIG. 18, the second body portion 542 may extend from the first and second walls 544, 546 of the first body portion 540. The flexible members 543 may extend from the second body portion 542 and may cooperate with the second body portion 542 to define a substantially circular-shaped opening 556 (FIG. 18). The flexible members 543 may be arcuate and may be spaced apart from respective walls 544, 546 of the first body portion 540. The flexible members 543 may snap into engagement with the groove 534*a* of the suction fitting 530 that is at or near the axial end 538 of the suction fitting 530. In this way, the deflector 532 is secured to the suction fitting 530.

Figure 20:
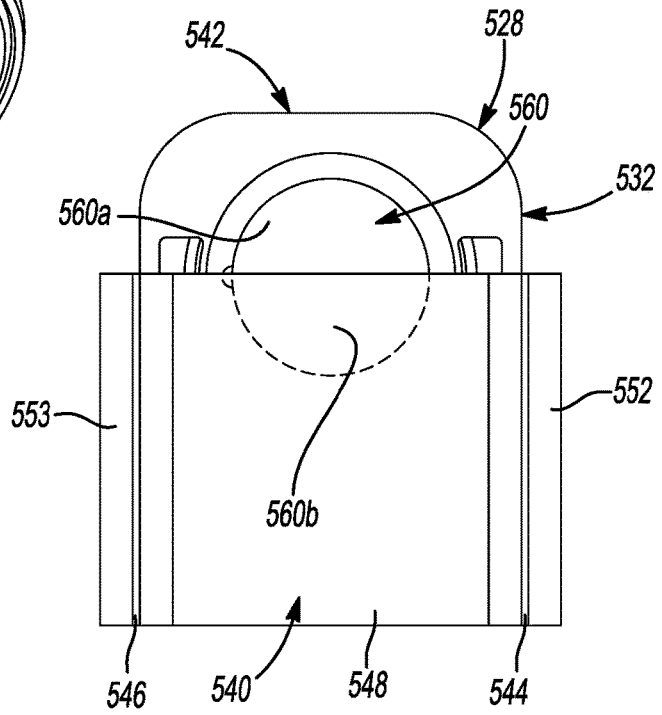
FIG. 20 is a front view of the suction fitting assembly with the suction fitting and the deflector connected to each other.

Once the suction fitting 530 is attached to the shell 32 and the flexible members 543 snap into engagement with the groove 534*a* of the suction fitting 530, the third wall 548 of the first body portion 540 may divide an outlet opening 560 of the suction fitting 530 into a first outlet opening section 560*a* and a second outlet opening section 560*b* (FIG. 20). In this way, a first portion of working fluid flowing through a passage 559 of the suction fitting 530 may exit the first outlet opening section 560*a* and flow toward the suction inlet 89 of the non-orbiting scroll 72 so that the first portion of working fluid can be directed into the radially outermost fluid pocket and subsequently compressed by the compression mechanism 20. A second portion of working fluid flowing through the passage 559 may exit the second outlet opening section 560*b* of the suction fitting 530. The second portion of working fluid exiting the second outlet opening section 560*b* may flow through the channel 550 of the first body portion 540 and may be directed toward the motor assembly 18 to cool the motor assembly 18. The first and second outlet opening sections 560*a*, 560*b* may be generally semi-circular shaped.

In the particular embodiment shown, the third wall 548 divides the outlet opening 560 such that the volume of the first portion of working fluid exiting the first outlet opening section 560*a* may be equal to the volume of the second portion of working fluid exiting the second outlet opening section 560*b* (i.e., the area of the first outlet opening section 560*a* is equal to the area of the second outlet opening section 560*b*). In some configurations, the third wall 548 may divide the outlet opening 560 such that the volume of the first portion of working fluid exiting the first outlet opening section 560*a* is more than the volume of the second portion of working fluid exiting the second outlet opening section 560*b* (i.e., the area of the first outlet opening section 560*a* is greater than the area of the second outlet opening section 560*b*).

In other configurations, the third wall 548 may divide the outlet opening 560 such that the volume of the first portion of working fluid exiting the first outlet opening section 560*a* is less than the volume of the second portion of working fluid exiting the second outlet opening section 560*b* (i.e., the area of the first outlet opening section 560*a* is smaller than the area of the second outlet opening section 560*b*).

As shown in FIGS. 16, 17 and 19, a partition 564 may extend from an end of the third wall 548 of the first body portion 540 toward the suction fitting 530. The partition 564 may prevent the second portion of working fluid exiting the second outlet opening section 560*b* from flowing toward the compression mechanism 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a chamber and a shell opening;

a compression mechanism disposed within the chamber of the shell assembly; and a suction fitting attached to the shell assembly and extending through the shell opening, the suction fitting including a portion extending into the chamber of the shell assembly, the portion of the suction fitting defining first and second openings, wherein the suction fitting directs working fluid through the first opening towards the compression mechanism and the suction fitting directs working fluid through the second opening away from the compression mechanism, wherein the portion of the suction fitting is sized and shaped such that the portion of the suction fitting can be inserted through the shell opening with the portion attached to the rest of the suction fitting, wherein the portion of the suction fitting has an axial end wall that defines the first opening at an axial end of the suction fitting, wherein the axial end wall extends radially inward relative to an inner diametrical surface of the portion of the suction fitting, wherein the first and second openings extend through the inner diametrical surface, wherein the inner diametrical surface is a cylindrical surface defined by a longitudinal axis that extends through the shell opening and through the axial end wall; and wherein the first opening has a larger area than the second opening such that a greater volume of working fluid flowing through the suction fitting flows out of the first opening than the second opening.

2. The compressor of claim 1, further comprising a motor disposed within the chamber and driving the compression mechanism, and wherein the suction fitting directs working fluid through the second opening towards the motor.

3. The compressor of claim 2, wherein the axial end wall deflects working fluid flowing through the suction fitting towards the first and second openings.

4. The compressor of claim 2, wherein the first and second openings extend radially through the inner diametrical surface of the suction fitting and an outer diametrical surface of the suction fitting.

5. The compressor of claim 1, wherein the second opening is an elongated slot, and wherein the first and second openings extend radially through the inner diametrical surface of the suction fitting and an outer diametrical surface of the suction fitting.

6. The compressor of claim 5, wherein the first and second openings are arcuate.

7. The compressor of claim 5, wherein a base plate is attached to the axial end of the suction fitting and cooperates with the suction fitting to define the first and second openings, wherein the base plate deflects working fluid flowing through the suction fitting towards the first and second openings.

8. The compressor of claim 1, wherein the axial end wall is flat and has a diameter that is no larger than a diameter of the shell opening.

9. The compressor of claim 8, wherein the suction fitting is a one-piece unitary body.

10. A compressor comprising:

a shell assembly defining a chamber;

a compression mechanism disposed within the chamber of the shell assembly and including a suction inlet;

a motor disposed within the chamber and driving the compression mechanism; and a suction fitting assembly including a suction fitting and a deflector, the suction fitting attached to the shell assembly and extending at least partially into the chamber, the deflector is attached to the suction fitting, wherein a first portion of working fluid exiting the suction fitting flows to the suction inlet of the compression mechanism and a second portion of working fluid exiting the suction fitting is directed toward the motor via the deflector, wherein the deflector includes a first body portion and a second body portion extending from the first body portion, and wherein the first body portion defines a channel that directs the second portion of working fluid flowing therethrough toward the motor, wherein the deflector includes a plurality of resiliently flexible members extending from the second body portion, and wherein the plurality of resiliently flexible members snap into engagement with the suction fitting, and wherein the deflector includes tabs that extends outwardly from ends of the first body portion, and wherein the tabs contact the shell assembly to bias the deflector against the suction fitting.

11. The compressor of claim 10, wherein the suction fitting includes an outlet opening, and wherein the first body portion divides the outlet opening into a first outlet opening section and a second outlet opening section.

12. The compressor of claim 11, wherein the first portion of working fluid exits the suction fitting through the first outlet opening section and the second portion of working fluid exits the suction fitting through the second outlet opening section.

13. The compressor of claim 12, wherein a partition extends from an end of the first body portion toward the suction fitting, and wherein the partition prevents the second portion of working fluid flowing through the second outlet opening section from flowing toward the compression mechanism.

14. A compressor comprising:

a shell assembly defining a chamber and a shell opening;

a compression mechanism disposed within the chamber of the shell assembly; and a suction fitting attached to the shell assembly and extending through the shell opening, the suction fitting including a portion extending into the chamber of the shell assembly, the portion of the suction fitting defining a first opening and including an axial end wall, wherein the suction fitting directs working fluid through the first opening towards the compression mechanism, wherein the portion of the suction fitting is sized and shaped such that the portion of the suction fitting can be inserted through the shell opening with the portion attached to the rest of the suction fitting, wherein the axial end wall defines an axial end of the suction fitting, wherein the axial end wall extends radially inward relative to an inner diametrical surface of the portion of the suction fitting, and wherein the first opening in the suction fitting extends through the axial end wall and through the inner diametrical surface, wherein the inner diametrical surface is a cylindrical surface defined by a longitudinal axis that extends through the shell opening and through the axial end wall, wherein the portion of the suction fitting defines a second opening, and wherein the second opening is an elongated slot, and wherein the first and second openings extend radially through the inner diametrical surface of the suction fitting and an outer diametrical surface of the suction fitting.

15. The compressor of claim 14, wherein the first opening is formed at the axial end of the suction fitting.

16. The compressor of claim 14, wherein the axial end wall deflects working fluid flowing through the suction fitting towards the first opening.

17. The compressor of claim 14, wherein the axial end wall is flat and has a diameter that is no larger than a diameter of the shell opening.

18. The compressor of claim 17, wherein the suction fitting is a one-piece unitary body.

19. The compressor of claim 14, wherein one of the first and second openings has a larger area than the other of the first and second openings.

* * * * *